US006835138B2

(12) United States Patent
Baeg

(10) Patent No.: US 6,835,138 B2
(45) Date of Patent: Dec. 28, 2004

(54) INTERNET BINGO GAME METHOD AND SYSTEM CAPABLE OF PROMOTING PERCEPTION AND STUDYING ABILITY

(76) Inventor: Chang Suhn Baeg, Jugong Apt. 111-501, 550 Eunhaing 2-dong, Joongwon-ku, Sungnam-si, Kyoungki-do (KR)

( * ) Notice: Subject to any disclaimer, the term of this patent is extended or adjusted under 35 U.S.C. 154(b) by 285 days.

(21) Appl. No.: 09/979,927

(22) PCT Filed: Mar. 27, 2001

(86) PCT No.: PCT/KR01/00491

§ 371 (c)(1),
(2), (4) Date: Nov. 27, 2001

(87) PCT Pub. No.: WO01/73520

PCT Pub. Date: Oct. 4, 2001

(65) Prior Publication Data

US 2002/0183108 A1 Dec. 5, 2002

(30) Foreign Application Priority Data

Mar. 28, 2000 (KR) ..... 2000-15905

(51) Int. Cl.[7] ..... A63F 9/24
(52) U.S. Cl. ..... 463/42; 463/19
(58) Field of Search ..... 463/16–20, 40, 463/42, 41; 434/307 A, 307 R, 308, 169, 309; 273/269, 274

(56) References Cited

U.S. PATENT DOCUMENTS 5,755,619 A * 5/1998 Matsumoto et al. ..... 463/19
5,791,991 A * 8/1998 Small ..... 463/41
6,012,984 A * 1/2000 Roseman ..... 463/42

* cited by examiner

*Primary Examiner*—Michael O'Neill
(74) *Attorney, Agent, or Firm*—Rosenberg, Klein & Lee

(57) ABSTRACT

If a person who opens Internet bingo game selects subjects, data pool is formed of many bingo data materials in a subject database, and $N^2$ bingo data materials are selected from data pool to fill an N×N bingo board, to thereby produce a data set. Then, using bingo data materials in data set, different data sets are produced by the number of users. When users apply for taking part in bingo game, data set is transmitted to fill a bingo board of each user terminal. Then, if $N^2$ bingo data materials are converted into multimedia data and multimedia data is randomly and subsequently provided to each user as playing card data, user clicks a corresponding block of the bingo board corresponding to corresponding playing card whenever users receive playing cards. If user who forms a preset bingo goal in the earliest announces a bingo, game terminates. If problems are provided to playing card data and bingo data materials in bingo board are provided as answers to problems, perception and learning ability to each subject can be promoted through game.

14 Claims, 22 Drawing Sheets

41

| ITEMS | KOREAN | ENGLISH | CHINESE | FRENCH | ••• |
|---|---|---|---|---|---|
| CHARACTER DATA | 나비 | BUTTERFLY | 蝶 | PAPILLON | ••• |
| AUDIO DATA | KOREAN PRONUN. | ENGLISH PRONUN. | CHINESE PRONUN. | FRENCH PRONUN. | ••• |

42

INTERNET BINGO GAME METHOD AND SYSTEM CAPABLE OF PROMOTING PERCEPTION AND STUDYING ABILITY

TECHNICAL FIELD

The present invention relates to an Internet bingo game method and a control system therefor capable of enhancing a perception and studying ability, and more particularly, to an Internet bingo game method and a control system therefor capable of enhancing a perception and studying ability with respect to each subject through a game, in which problems are provided to playing card data as multimedia data and bingo data materials for use in a bingo board are provided as answers with respect to the problems.

BACKGROUND ART

In general, in the case of a bingo game, a number of game participants come together in a certain place, make a bingo board 6 having a 5×5 matrix table containing twenty-five rooms in total as shown in FIG. 1, respectively and then fill in the blank rooms with figures of 1 through 25 at random. A person who is charged with proceeding with the bingo game calls out a figure "25" of a playing card 7 according to his or her predetermined sequence and each participant marks his or her own bingo board room filled with the same figure "25" as the playing card figure, to then repeat the above figure call and mark procedures. In this case, if any one who forms a preset bingo goal in his or her bingo board in the earliest calls out a "bingo" the bingo game is finished or the game participants are ranked in a bingo formation order.

In general, a bingo goal is classified into a single bingo (FIG. 2A) in which a straight line is formed in any direction when five rooms are marked in a bingo board, a double bingo (FIG. 2B) in which two straight lines are formed in a bingo board, a triple bingo (FIG. 2C) in which three straight lines are formed in a bingo board, and a pattern bingo (FIG. 2D) in which a particular shape, for example, a particular pattern such as a waterfall (3*a*), a baby carriage (3*b*), a "T"-shaped pattern (3*c*), a pyramid (3*d*) and a kettle cover (3*e*) is formed in a bingo board.

However, in the case of the conventional bingo game, people who wish to play a bingo game should proceed according to instructions of a person who is charged with proceeding with the bingo game while gathering at a certain place. Also, the conventional bingo game is a simple entertainment game enjoyable together with at least one counterpart. As a result, the conventional bingo game cannot be played together with other people who are at a remote distance.

Also, since the conventional bingo game proceeds with only simple figures, educational applications for enhancing a perception ability or a learning effect of a particular category have not been accomplished.

DISCLOSURE OF THE INVENTION

To solve the above problems, it is an object of the present invention to provide an Internet bingo game method and system capable of enhancing a perception and studying ability with respect to a particular subject through a game, in which problems for enhancing a perception and studying ability by use of multimedia data are provided as playing card data provided from a server to a participant's terminal during playing the Internet bingo game formed of the particular subject, and bingo data materials for use in a bingo board are provided as answers with respect to the problems.

It is another object of the present invention to provide an Internet bingo game method and system capable of inducing a game participant to undergo learning an explanation with respect to a game subject to be selected before the game participant participates in a bingo game of a particular subject and further enhancing a perception and studying ability with respect to each subject.

It is still another object of the present invention to provide an Internet bingo game method and system capable of enhancing a learning ability of various languages including Korean and English, during playing a bingo game using the Internet, in which playing card data is configured by multimedia data including graphic data (or moving images), character data and audio data, in order to graphically present playing cards, while displaying characters under the cards and simultaneously outputting acoustic data repeatedly, to thereby induce the participant to understand the characters and acoustic data to then click a corresponding bingo block in a bingo board.

It is yet another object of the present invention to provide an Internet bingo game method and system in which a publicity of a company or an advertisement of a product is established as a game subject, to thereby provide a learning before playing a game and advertisement information via the game.

To accomplish the above object of the present invention, there is provided an Internet bingo game method having an effect of enhancing a perception ability and a learning ability, the Internet bingo game method comprising the steps of: making a bingo data set with $N^2$ selected bingo data materials in order to fill an N×N bingo board in which N is an integer equal to or more than three, from a number of subject database when at least one user applies for participating in a game; aligning the $N^2$ bingo data materials in the data set at random to thereby produce respectively different data sets by as many as the number of game participants; transmitting the respectively different bingo data set from a system server to each participant terminal so as to fill a bingo board of each participant terminal; converting the $N^2$ bingo data materials into multimedia data and providing the multimedia data randomly and sequentially to each participant as playing card data; and selecting a corresponding block of the bingo board corresponding to a corresponding playing card whenever the participant receives the playing card, to thereby make a participant who forms a predetermined bingo goal pattern in the earliest announce a bingo.

Also, the Internet bingo game method according to the present invention further comprises the step of allowing a game participant to learn an explanation with respect to a game subject to be selected before or after participating a bingo game.

Moreover, the Internet bingo game method according to the present invention further comprises the steps of setting a game configuration in order to establish a game subject, a game level, a maximum number of gamers, use language, a gaming rule, a goal pattern and a game option of the bingo game, and storing the set game configuration.

Preferably, the present invention further comprises the step of selecting language of character data and audio data included in the multimedia data.

In the case that a secondary bingo announcement is made by the same participant as a primary bingo announcer in the result of proceeding with a game in succession to the primary bingo announcement, it is preferable that the present invention further comprises the steps of accumulating a winning point of the participant and uploading the game result. Also, the present invention further comprises the steps of inputting an identification (ID) of the participant before uploading the game result and updating the winning point of the participant in a participant operator server.

The problem presented as the playing card is any one of an antonym, a synonym, a Chinese character phrase, and an operation question, and the subject is any one of advertisement information of a company, entertainment, hobby and common sense. The graphic data presented as the playing card may be an illustration relating to a selected subject and the audio data may be a foreign language conversation relating to the illustration.

To accomplish the other object of the present invention, there is also provide an Internet bingo game system comprising: a number of Internet accessible participant terminals each including a web browser; and a system server including a bingo database configured to have a number of subject databases each including a number of subject bingo data materials, and a web server making a bingo data set with $N^2$ selected bingo data materials in order to fill an N×N bingo board in which N is an integer equal to or more than three, from a number of subject databases when at least one user applies for participating in a game, aligning the $N^2$ bingo data materials in the data set at random to thereby produce respectively different data sets by as many as the number of game participants, transmitting the respectively different bingo data set to each participant terminal so as to fill a bingo board of each participant terminal, converting the $N^2$ bingo data materials into multimedia data and providing the multimedia data randomly and sequentially to each participant as playing card data, selecting a corresponding block of the bingo board corresponding to a corresponding playing card whenever the participant receives the playing card, to thereby make a participant who forms a predetermined bingo goal pattern in the earliest announce a bingo, wherein problems enhancing a perception and learning ability are correspondingly provided to the playing card data and the bingo data materials in the bingo board are provided as answers with respect to the problems.

The system server comprises: a bingo board display displaying his or her own bingo board on each participant terminal when a participant applies for taking part in a bingo game of the system server; a number of small-sized bingo board displays for identifying other participants' proceeding situations; a playing card display displaying graphic data of the playing card; a character data display displaying the character data of the playing card; and a game screen including a chatting space for allowing for communicating an item to be transmitted between the participants.

Also, the Internet bingo game system according to the present invention further comprises a learning database including a number of learning data materials for explaining the subject bingo data materials in detail. The game screen in the present invention further comprises a learning select menu for selecting learning data materials relating to the game subject.

As described above, if one or more subjects are selected among a number of subjects according to the level of the game participants during playing an Internet bingo game in the present invention, a data pool is formed of a number of bingo data materials included in a subject database, and 25 bingo data materials are selected from the data pool in order to fill a bingo board, to thereby produce a data set, and then using the bingo data materials in the data set, the bingo data materials are randomly aligned by as many as the number of the game participants, and the 25 bingo data materials are randomly provided to each participant as playing card data.

Here, problems enhancing a perception and learning ability are provided to the playing card data provided from the server to the participant terminal, as multimedia data, and the bingo data materials for the bingo board are provided as answers with respect to the problems, to thereby enhance a perception and learning ability with respect to each subject via a game.

Also, the Internet bingo game method and system is capable of inducing a game participant to undergo learning an explanation with respect to a game subject to be selected before the game participant participates in a bingo game and further enhancing a perception and studying ability with respect to each subject.

Further, the Internet bingo game method and system can enhance a learning ability of various languages including Korean and English, during playing a bingo game using the Internet, in which playing card data is configured by multimedia data including graphic data (or moving images), character data and audio data, in order to graphically present playing cards, while displaying characters under the cards and simultaneously outputting acoustic data repeatedly, to thereby induce the participant to understand the characters and acoustic data to then click a corresponding bingo block in a bingo board.

Further, the present invention provides an effect of providing advertisement information via a learning before playing a game and via the game, in the case that a publicity of a company or an advertisement of a product is established as a game subject, in addition to the educational materials.

Also, the present invention provides an effect of inducing specialists of various fields into a game, in the case that a variety of entertainments, amusements, hobbies and common senses are established as a game subject, in addition to the educational materials.

BRIEF DESCRIPTION OF THE DRAWINGS

The above objects and other advantages of the present invention will become more apparent by describing the preferred embodiments thereof in more detail with reference to the accompanying drawings in which.

BEST MODE FOR CARRYING OUT THE INVENTION

Preferred embodiments of the present invention will be described in greater detail with reference to the accompanying drawings.

Figure 1:
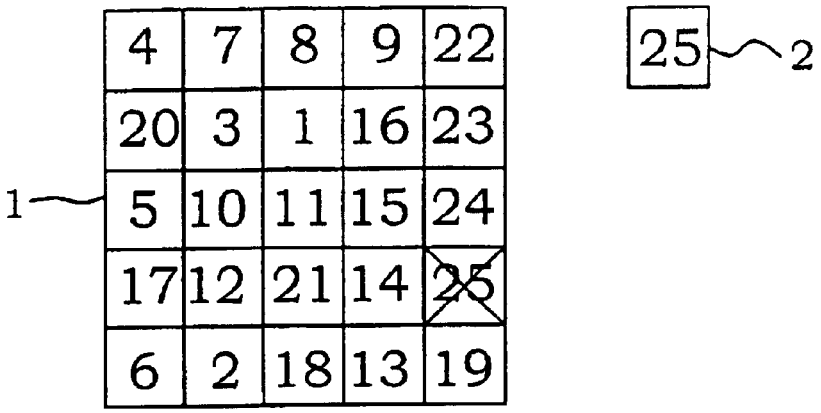
FIG. 1 is a view for explaining a general figure bingo game.
Figure 2A:
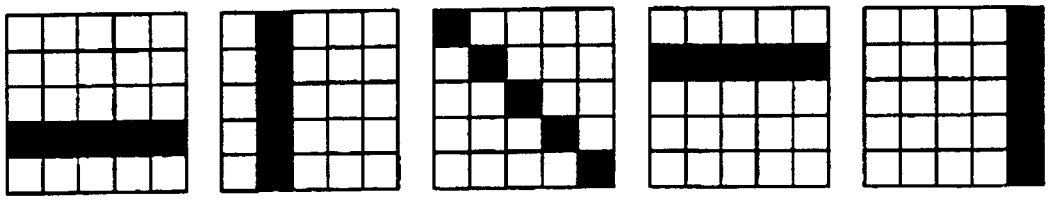
FIGS. 2A through 2D show examples of various bingo goals.
Figure 2B:
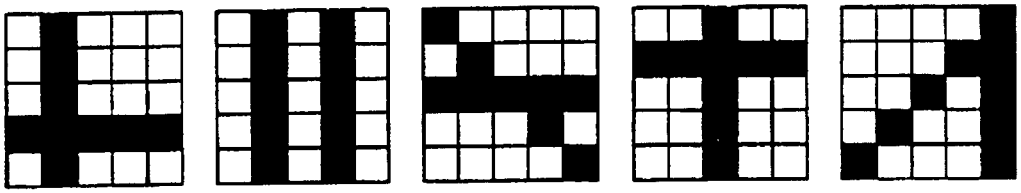
Figure 2C:
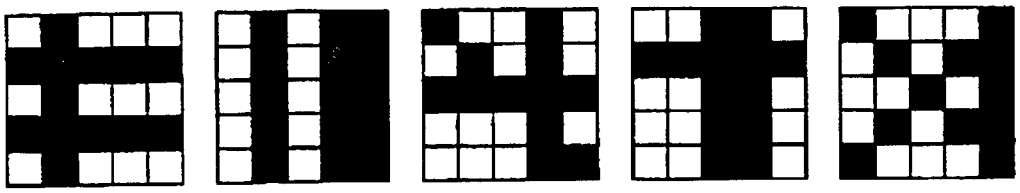
Figure 2D:
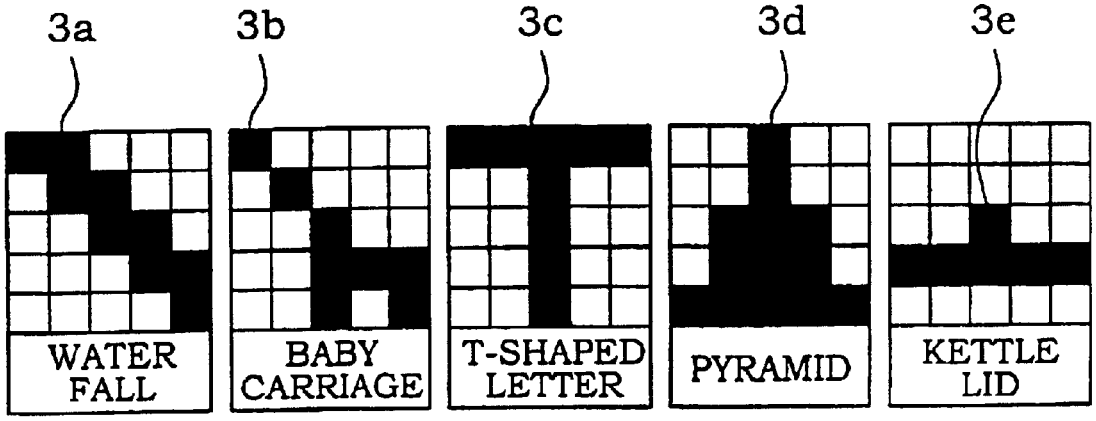
Figure 3A:
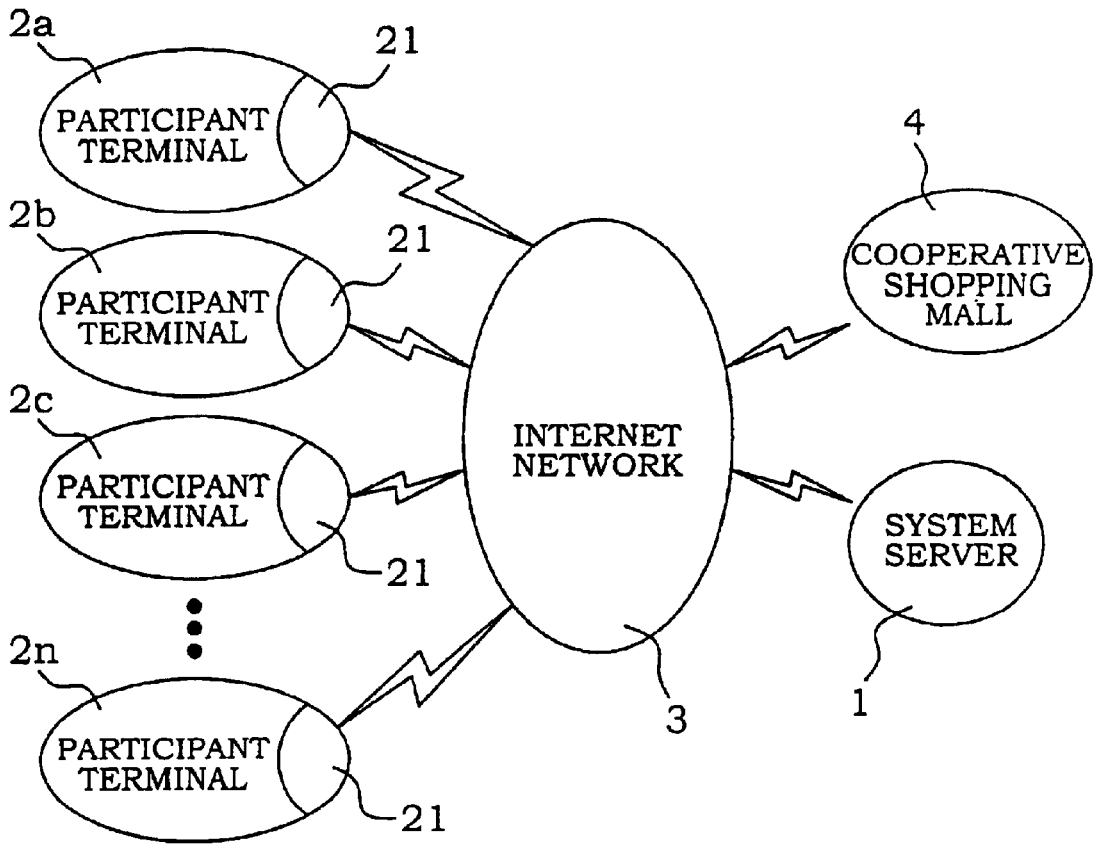
FIG. 3A is a schematic view showing an Internet bingo game system having a perception and learning ability enhancing effect according to the present invention.

FIG. 3A is a schematic view showing an Internet bingo game system having a perception and learning ability enhancing effect according to the present invention. First, referring to FIG. 3A, an Internet bingo game system according to an embodiment of the present invention includes a system server 1 connected to the Internet network 3, for managing a progress of an Internet bingo game and the entire procedure, a number of user terminals (such as personal computers (PCs) 2*a*–2*n* which allows a number of users to connect to the system server 1 via the Internet network 3, and a cooperative shopping mall server 4 linked with the system server 1 and connect to the system server 1 via the Internet network 3, for running a shopping mall in cooperation with an operating business manager of the system server 1. In FIG. 3A, a reference numeral 21 denotes a modem for enabling a user terminal to connect to the Internet network to perform an Internet communication with the system server 1 or the shopping mall server 4.

Figure 3B:
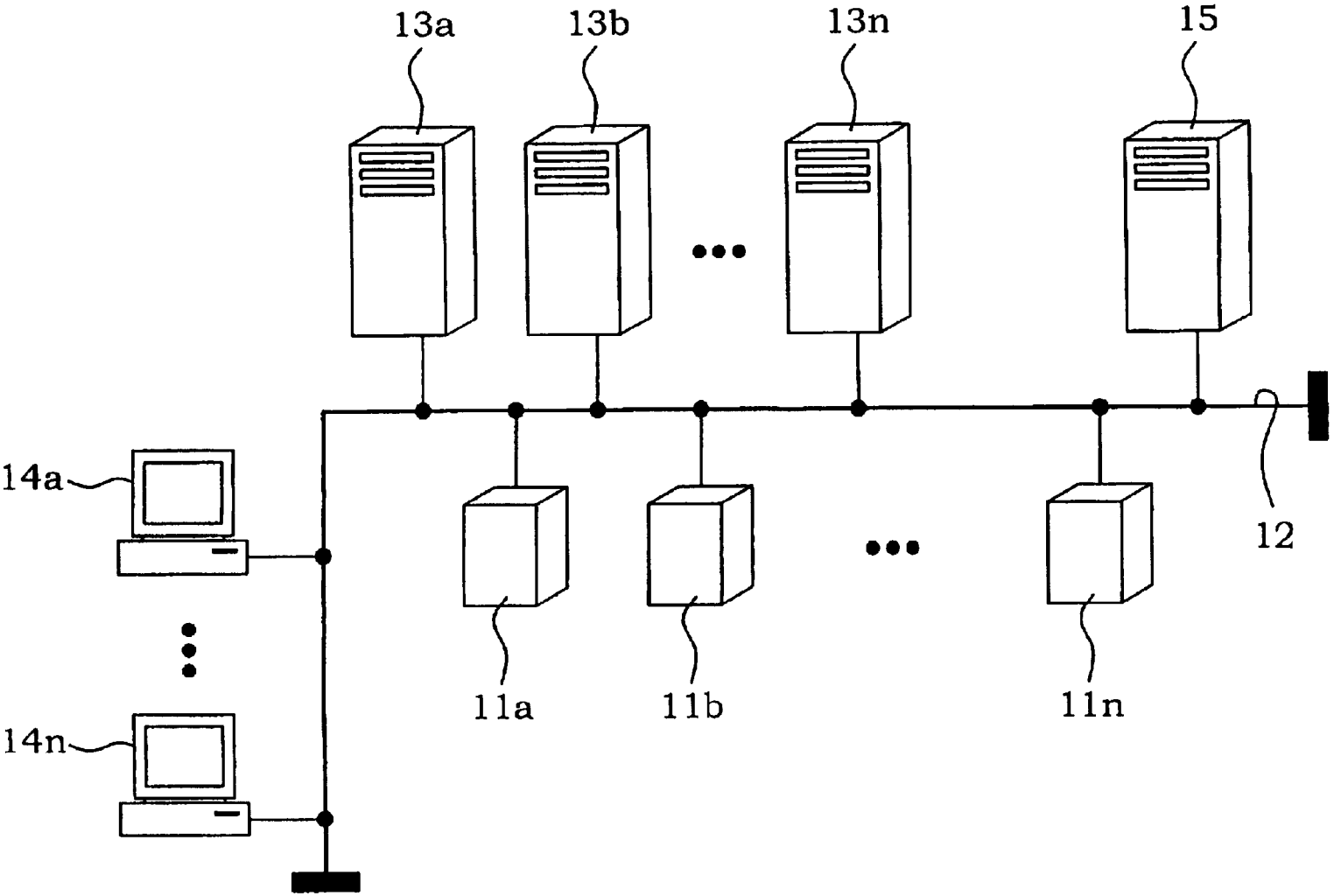
FIG. 3B is a schematic view showing a system server of FIG. 3A.

FIG. 3B is a schematic view showing the internal system of the system server 1 of FIG. 3A. A number of web servers 11*a*–11*n* each including a web server engine which can serve bingo game data and learning data via the Internet are connected to a LAN (Local Area Network) 12 when the system server 1 is connected via the Internet. Also, a number of database (DB) servers 13*a*–13*n* are connected to the LAN 12 in order to store the bingo game data and the learning data input by the users and the operators and manage data extracted according to a user inquiry. Finally, a number of system administrator terminals 14*a*–14*n* which always stand by in order to monitor the number of web servers 11*a*–11*n* and the number of DB servers 13*a*–13*n* in the system server 1 and repair them during making troubles, are connected to the LAN 12.

A connection between the system server 1 and the number of user terminals 2*a*–2*n* can adopt both a wired Internet connection method using a modem and the PSTN, dedicated cable or ISDN, and a wireless Internet connection method using a cellular phone or PCS phone and a microwave or satellite communication network. Any one which can access the Internet network 3 using one of the above Internet connection methods can be used as each of the user terminals 2*a*–2*n*.

Preferably, any one type of a PC or a terminal which includes an Internet web browser 21 supporting an Internet connection of a general PC having a microprocessor of Pentium (registered trademark of Microsoft Inc.) class or higher, a hard disc driver, a communication modem, a multimedia receiver and so on, can be used as each of the user terminals 2*a*–2*n*.

Further, in addition to the PC, an Internet accessible terminal such as a workstation, a general portable communication terminal (PCS or PHS), a PDA, a set-top-box, a digital TV and a web phone, can be used as each of the user terminals 2*a*–2*n*.

Also, the system server 1 can include a hub for distributing signals via each LAN card installed in the number of web servers 11*a*–11*n*, the DB servers 13*a*–13*n*, and the system administrator terminals 14*a*–14*n*, a router for connecting the hub of the system with the Internet network 3, and a CSU (Channel Service Unit).

In the internal connection system of the system server 1, the number of the web servers 11*a*–11*n* is determined according to how many user terminals 2*a*–2*n* are connected to the system server. The internal network in the system server 1 can be configured in a well-known method according to the number of the web servers.

Figure 4A:
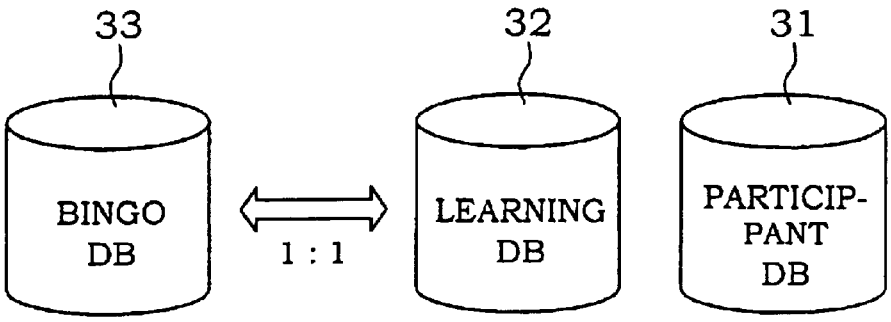
FIG. 4A is a schematic view showing databases (DBs) in the system server according to the present invention.

The DB servers 13*a*–13*n* can be configured as a DBMS (Data Base Management System). The database (DB) contained in the DB server is largely classified into a member DB 31, a learning DB 32, and a bingo DB 33, as shown in FIG. 4A. It is apparent to a person having an ordinary skill in the art that the DBs 31–33 can be subdivided or integrated if desired.

First, the member DB 31 includes various fields concerning registered member personal particulars, such as a member name field, a residence number field, a zip code field, an address field, a portable phone number field, a home phone number field, an ID field for identifying a member during performing a log-in to the server, a password field, a password confirmation field, a member occupation field, a member game participation disposition, a game name field and a game record of performance field of a member in order to analyze the frequency of use of a game and game record of performance of the member, an account field containing a deposit money (e.g. cyber cash) given to a member according to the record of performance of a game and making the member ascertain the deposit money, and a member hobby field. If desired, the member DB 31 further includes an item for managing a credit point in order to administrate a credit of a member.

Figure 4C:
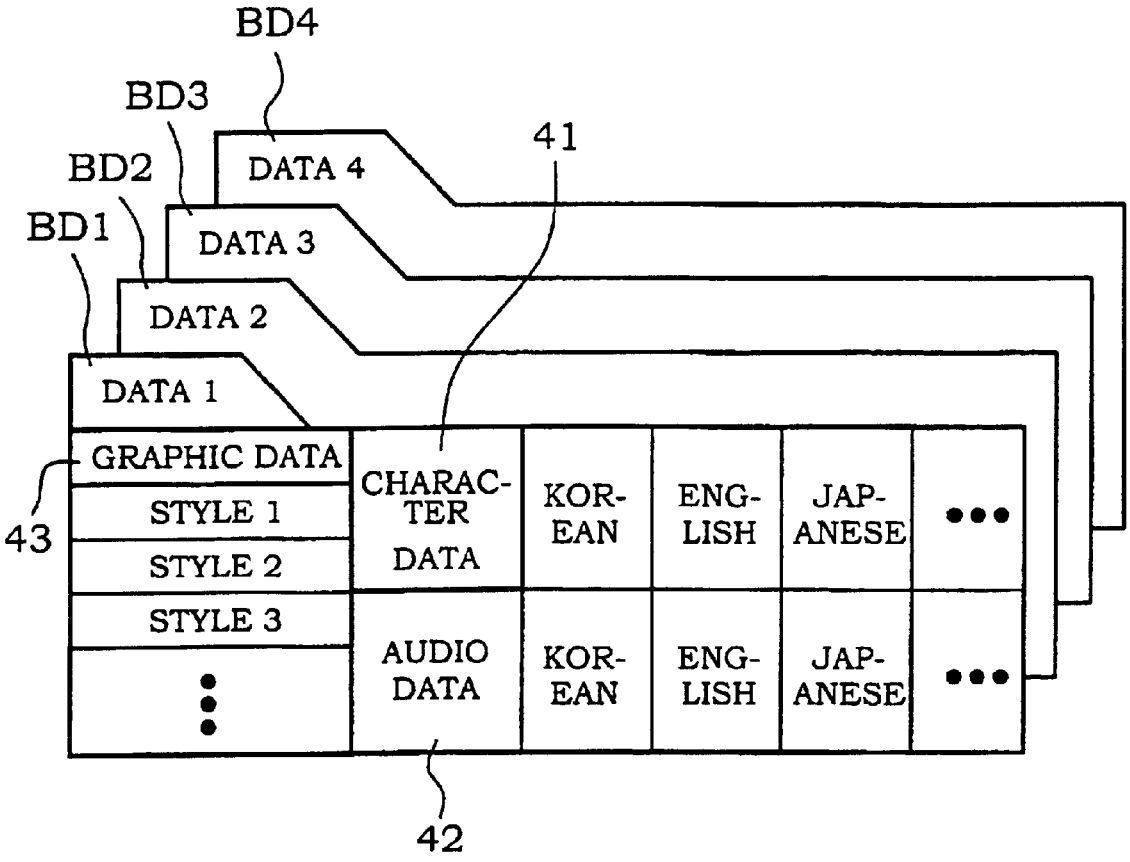
FIG. 4C shows a bingo data structure.
Figure 4B:
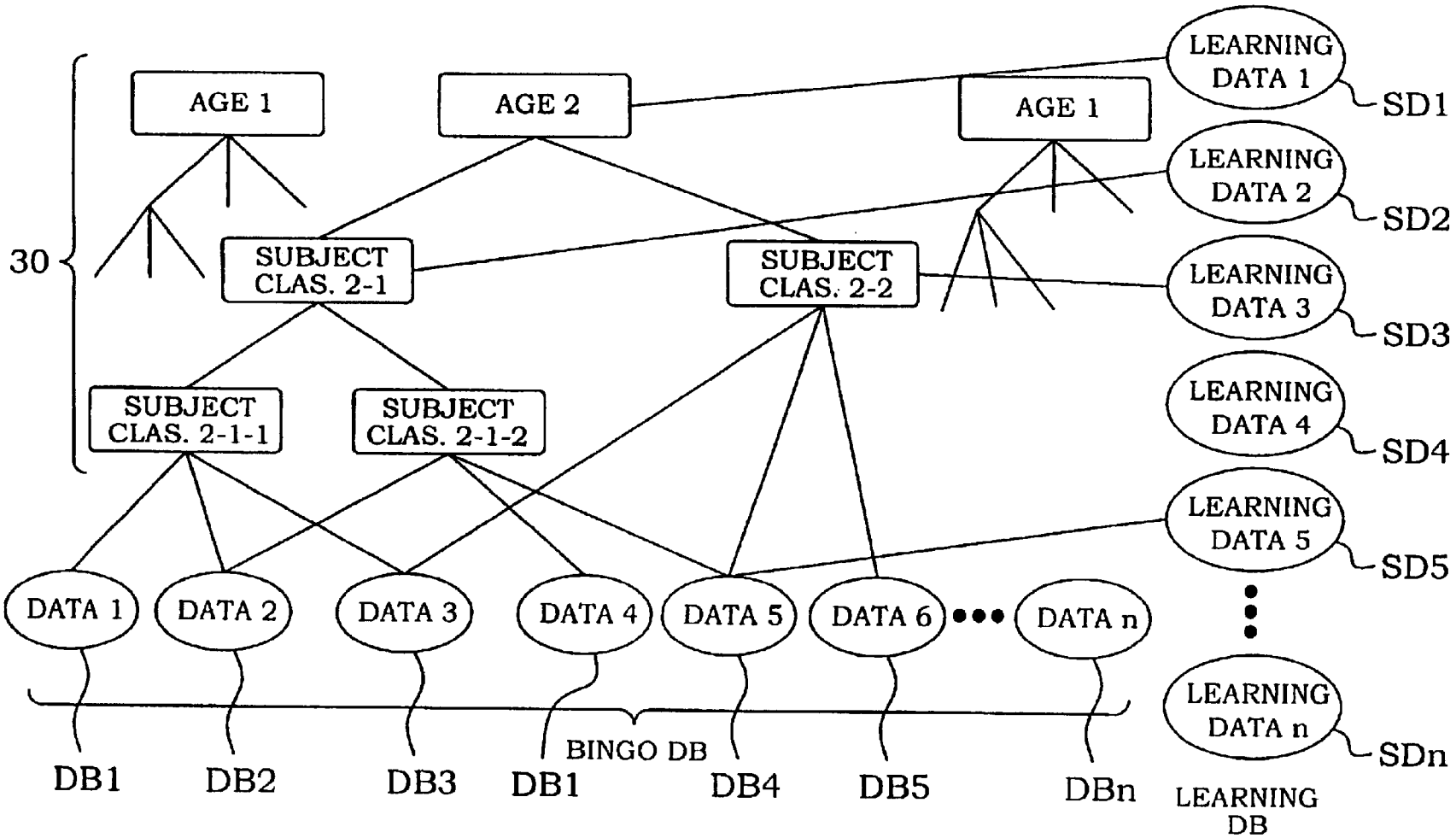
FIG. 4B is a view for explaining the relationship between a bingo DB and a learning DB.

Meanwhile, as shown in FIG. 4B, the learning DB 32 includes a number of learning data materials SD1-SDn, and the bingo DB 33 includes a number of bingo data materials BD1-BDn. The learning data materials SD1-SDn are configured to correspond to the bingo data materials BD1-BDn and the subject classification system 30. That is, the learning data materials SD1-SDn include information for explaining each subject, or detailed information relating to each data, if necessary.

The bingo data materials BD1-BDn are combined by the subject classification system 30, and the subject classification system 30 has an individual system by the disparity of age.

As shown in FIG. 4C, the bingo data materials BD1-BD-n include the character data 41, the audio data 42 and the graphic data 43. The character data 41 includes character data of the major languages such as Korean, English, Japanese and Chinese with respect to "butterfly" as an example. The audio data 42 includes pronunciation of each language with respect to each corresponding character data. As shown in FIG. 4E, the character data 41 and the audio data 42 are coupled in a pair.

Figure 4D:
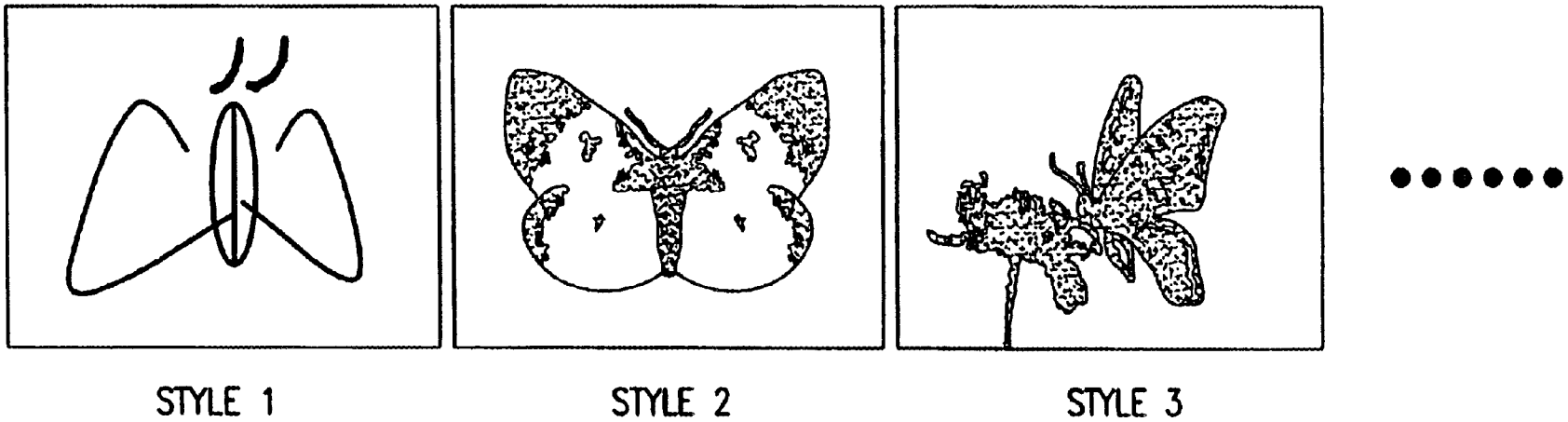
FIG. 4D shows an example of graphic data among the bingo data materials.
Figures 4E, 4F:
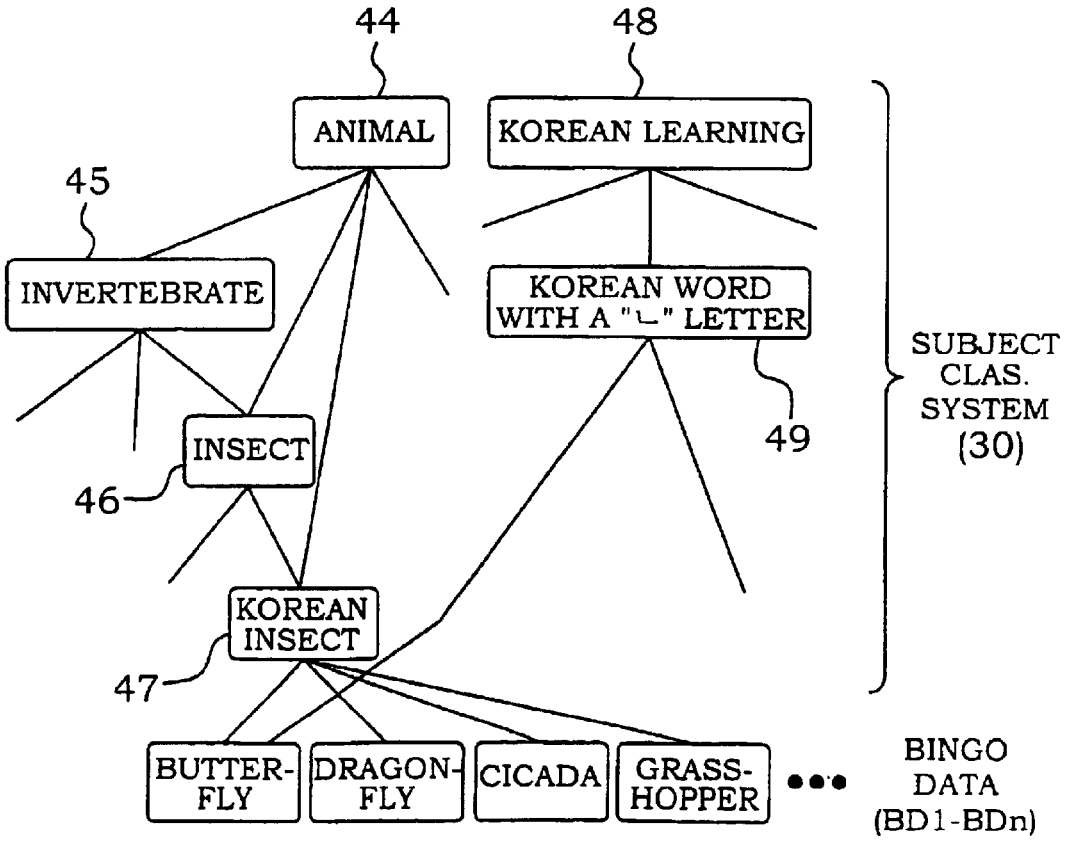
FIG. 4E is a table showing the relationship between character data and audio data.
FIG. 4F is a view for explaining the relationship between a subject classification system and bingo data.

As shown in FIG. 4D, the graphic data 43 includes graphic data of a variety of styles (style1–style3) corresponding to a corresponding character, in which a user can display the graphic data of a desired style on a bingo board according to his or her taste.

The subject classification system 30 is simply described below with reference to FIG. 4F. In the case that a subject is an animal, an invertebrate animal 45 is classified as a middle group in a large group grouped as animals 44, and an insect 46 and a Korean insect 47 are classified as a small group in the invertebrate animal. Accordingly, a butterfly 51, a dragonfly 52, a cicada 53, a grasshopper 54 and so on are included in the Korean insect 47, which form part of the bingo data materials BD1-BDn.

Also, in the case that a subject is a Korean learning, a Korean word 49 containing a "ㄴ" letter as an example is included as a middle group in a large group grouped as the Korean learning 48. A butterfly 51 included in the group of the Korean insect 47 is included in the Korean word 49 containing a "ㄴ" letter. Thus, the respective bingo data materials BD1-BDn are included in a number of subjects, and can be selected by a user subject selection.

In FIG. 4F, the learning data forming the learning DB 32 can be an explanation with respect to the subject classification system 30 or the bingo data materials.

That is, in the case of the animal 44, the learning data includes an encyclopedic explanation, textual materials, images and so on with respect to the animal. In the case of the Korean insect 47, the learning data includes an explanation and materials with respect to distribution of the Korean insects, the growth features thereof and so on. In the case of the butterfly 51, the learning data includes an explanation and materials with respect to the features, metamorphoses and so on. In the case of the Korean learning 48, the learning data includes an introduction of Korean learning methods for kids, an introduction of a Korean learning theory for foreigners, and so on. In the case of the Korean word 49 containing a "ㄴ" letter, the learning data includes an explanation of the features of a "ㄴ" letter pronunciation, images of a mouth shape during pronunciation of a "ㄴ" letter.

Figure 5A:
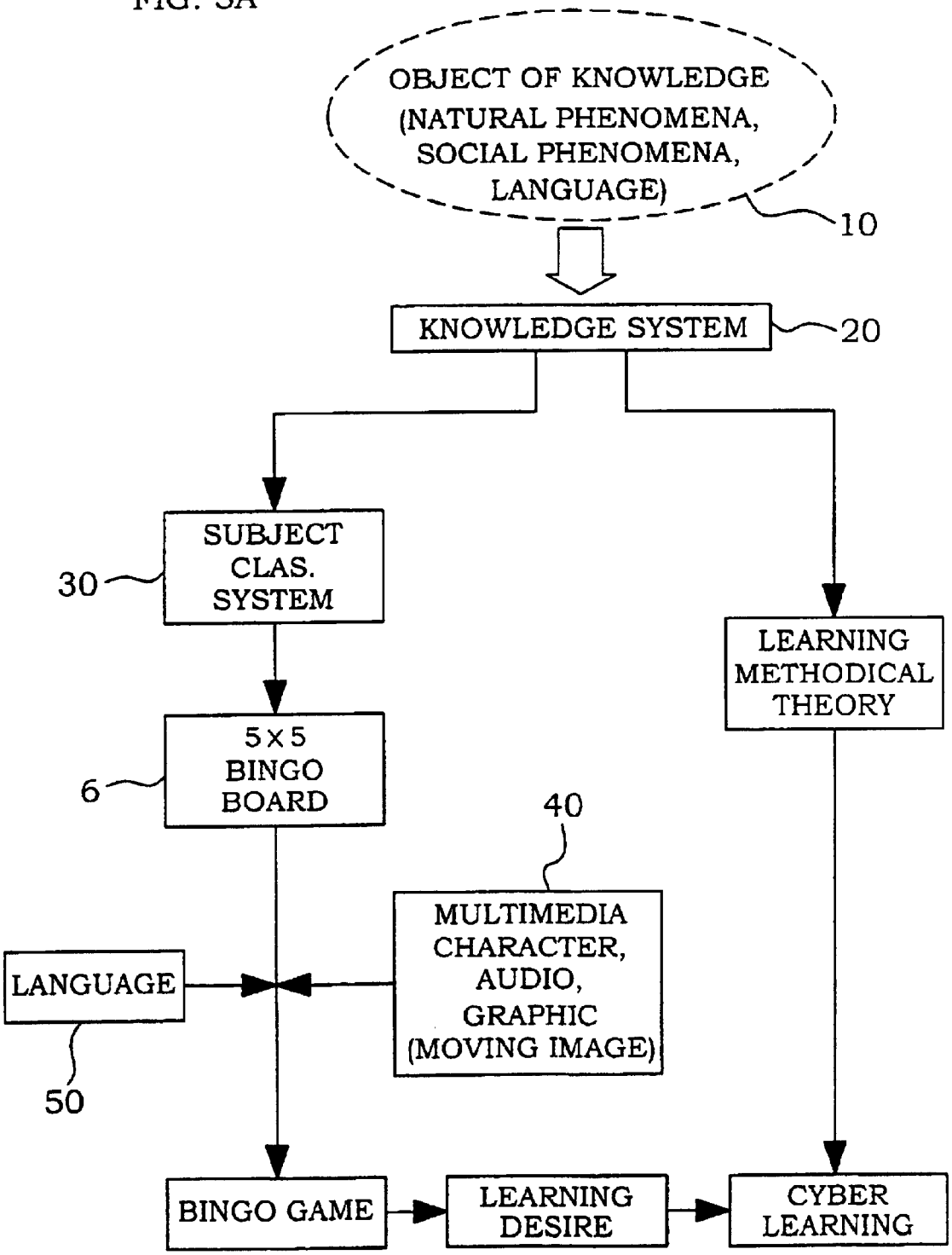
FIG. 5A is a view for explaining a principle of enhancing a perception and learning ability via an Internet bingo game according to the present invention.
Figure 5B:
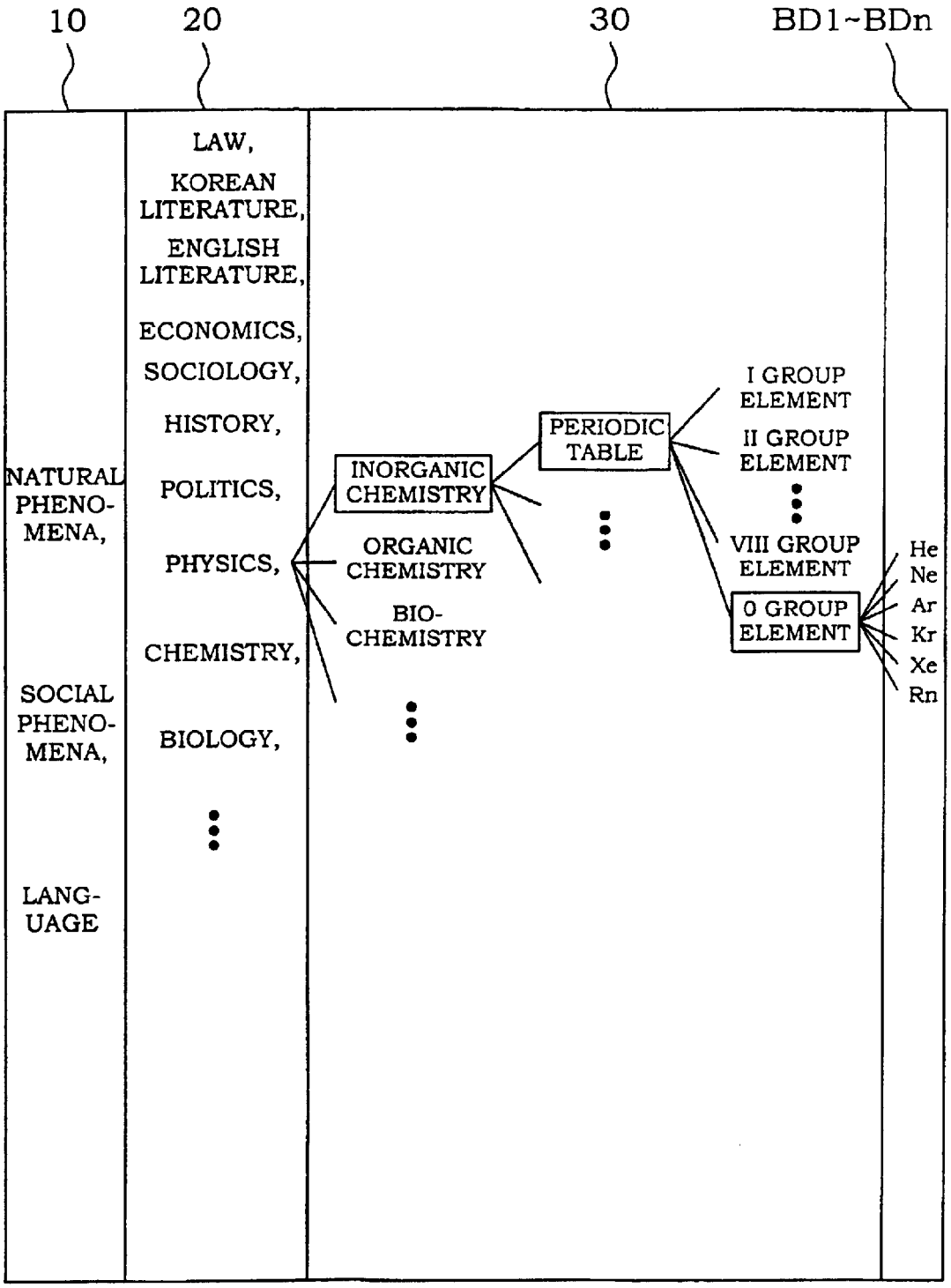
FIG. 5B is a systematic diagram showing the relationship among a knowledge object, a knowledge system, a subject classification system and bingo data of FIG. 5A.

Hereinbelow, a principle of enhancing a perception and learning ability according to the Internet bingo game of the present invention will be described with reference to FIGS. 5A and 5B.

Assuming that various natural phenomena, social phenomena, languages and so on which confront for life are objects 10 of knowledge which should be comprehended, these can be classified into law, Korean literature, English literature, economics, sociology, history, politics, diplomatics, broadcasting, physics, chemistry, biology, geography, astronomy, mechanical engineering, electronics engineering, chemical engineering, civil/architecture engineering, design, home science, medical science, psychology, philosophy, physical science, aesthetics, and so on, according to a knowledge system 20.

The chemistry among the knowledge system 20 is subdivided into the subject classification system 30 such as an inorganic chemistry, an organic chemistry, and a biochemistry. The inorganic chemistry 30*a* includes the periodic table 30*b* of the elements as an example. The periodic table 30*b* includes elements 30*c* of I–VIII and 0 groups. For example, He, Ne, Ar, Kr, Xe and Rn are included in the 0 group elements 30*c*. That is, He, Ne, Ar, Kr, Xe and Rn are included as the subject of the 0 group elements in a part of the bingo data materials BD1-BDn.

As described above, the knowledge object 10 is grouped as a number of subjects according to the knowledge system 20 and the subject classification system 30. Each subject partially includes a number of bingo data materials BD1-BDn.

Meanwhile, when the number of bingo data materials BD1-BDn are determined or selected as at least one subject by a user, a data pool is formed as data relating to a corresponding subject.

In this case, 25 bingo data materials are selected from the data pool in order to fill a bingo board 6 having a 5×5 blocks. The bingo data materials are aligned randomly by as many as the number of the game participants, to thereby produce a data set, and then the bingo board of each participant terminal is filled using the bingo data materials in the data set. Then, the 25 bingo data materials are randomly and sequentially provided to each participant as playing card data, to thereby play a bingo game.

Here, when problems enhancing a perception and learning ability are provided to the playing card data provided from the server to the participant terminal, as multimedia data 40 including character data 41, audio data 42, and graphic (moving image) data 43, the character data and the audio data is selected as character data and audio data of the language 50 selected by a language selection, and the bingo data materials for the bingo board are provided as answers with respect to the problems.

Thus, the participants are interested in the game during repetition of the bingo game and feel a learning desire at the same time, to thereby peruse the learning data SD1-SDn to get a cyber learning. Accordingly, a perception and learning ability with respect to each subject is enhanced. In this case, if a learning preparation, a learning performance and a learning estimation are accomplished on the basis of a learning methodical theory during a cyber learning of the learning data materials SD1-SDn, a perception and learning ability can be further enhanced.

Figure 5C:
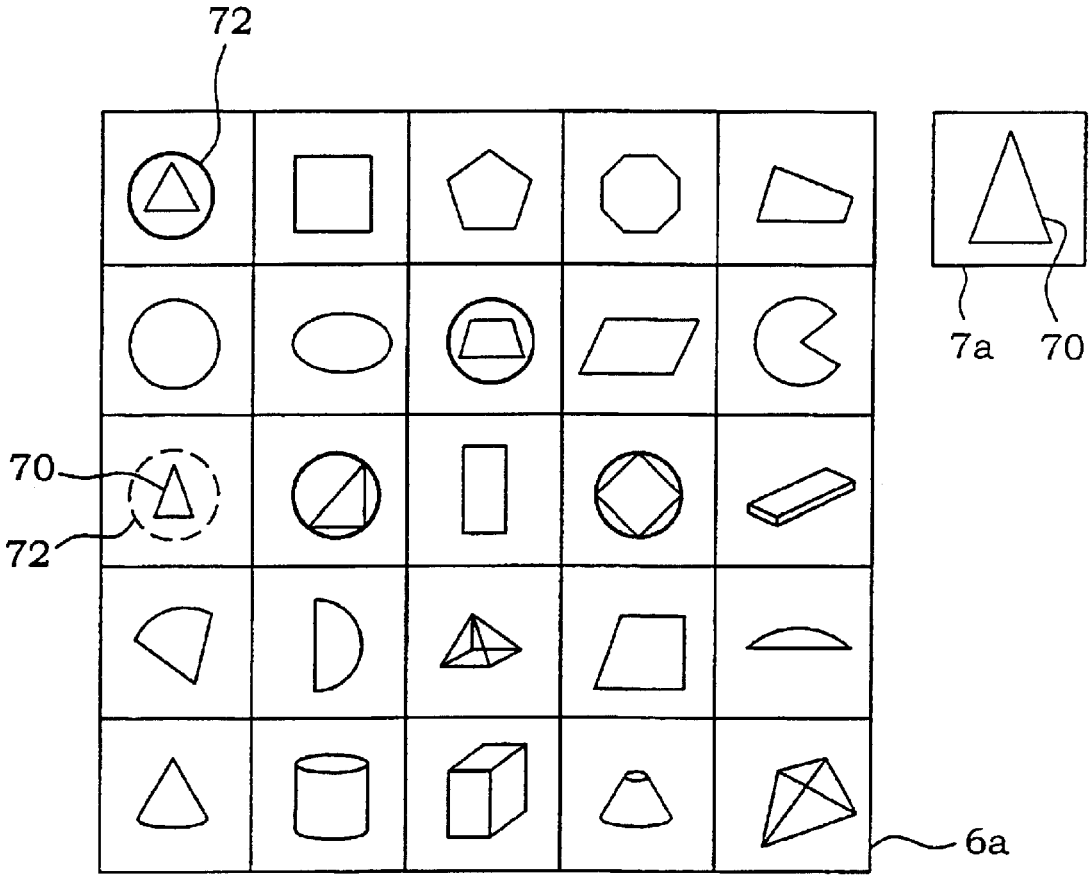
FIG. 5C shows examples of a bingo board and a playing card in the case that a figure subject is selected.

FIG. 5C shows examples of a bingo board and a playing card in the case that a figure subject is selected. If a game is played with a figure subject, it is possible to configure a bingo board 6 as shown in FIG. 5C. Since the number of participants participated in the game is plural, each the bingo boards 6 can be aligned differently from each other.

Figure 14:
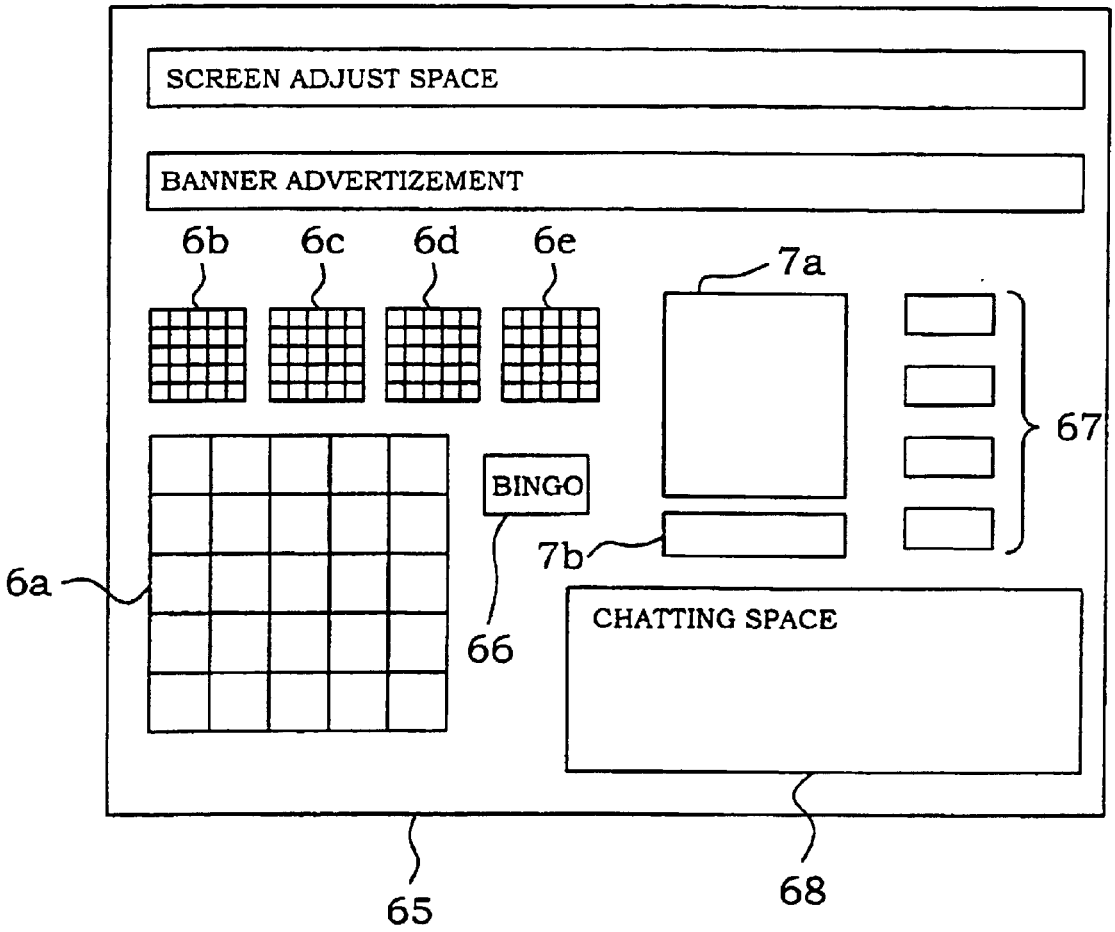
FIG. 14 shows an example of a game screen during playing a game between five participants according to the present invention.
Figure 15:
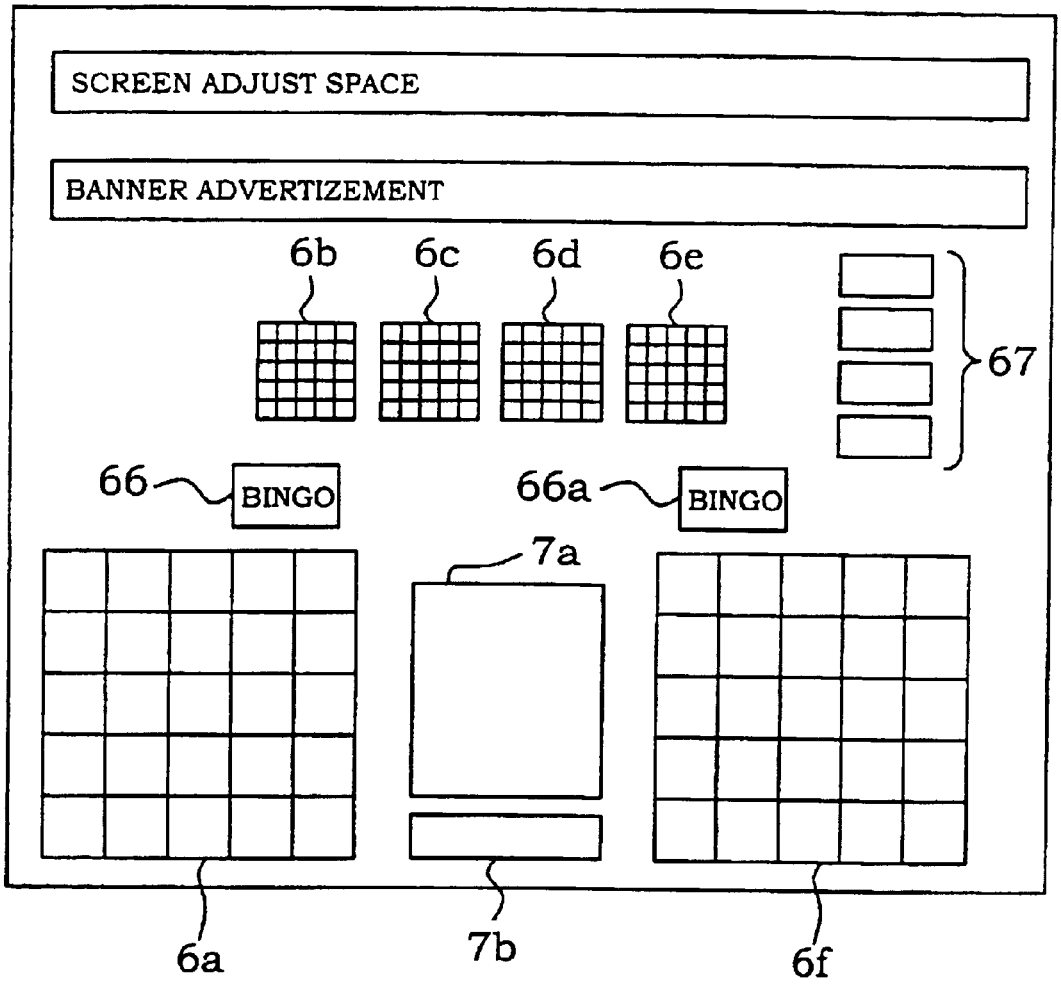
FIG. 15 shows an example of a screen in the case that two participants play a game in a single client terminal according to the present invention.

A playing card 7*a* is selected at random among the card data materials presented in the bingo board 6. For example, when a playing card 7*a* of an isosceles triangle 70 is selected, the figure of the isosceles triangle 70 is provided to the participant terminal as graphic data 43 of FIG. 4C. The playing card 71 under which the character data 41 of the "isosceles triangle" is written or whose character data is written in a separate character data display 7*b* of FIGS. 14 and 15 is provided. Accordingly, if each participant clicks a block containing the same figure of the isosceles triangle 70 as that of the playing card 7 from his or her bingo board 6, a circular mark 72 is displayed.

If a pattern of the blocks marked with the circular mark 72 is equal to a predetermined bingo goal, for example, forms a straight line in any one direction or forms a particular shape, by repeating the above process, a game participant announces a "bingo" and a declares a victory of the game. Thus, the participant recognizes various figures via the game and learns the names of the figures by heart.

Figure 6:
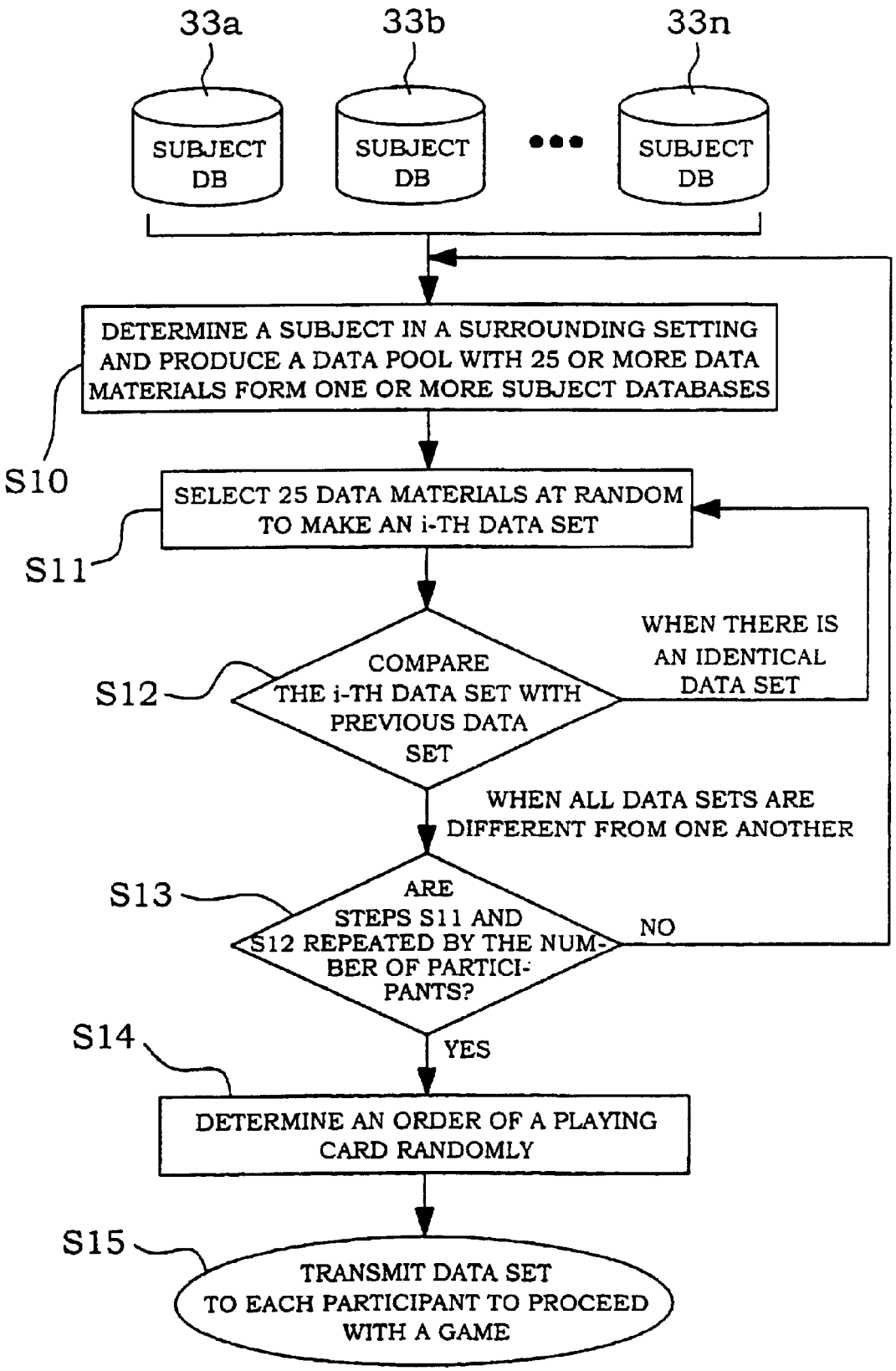
FIG. 6 is a flowchart view showing a basic model with respect to creation of a bingo board and a playing card according to the present invention.

Hereinbelow, referring to FIG. 6, a basic model with respect to creation of a bingo board and a playing card according to the present invention will be described.

The bingo DB 33 includes a number of subject DBs 33*a*–33*n*. In this case, if a user, that is, a game participant selects at least one game subject in a configuration setting process to be described later, twenty-five data materials or more creates a data pool from the corresponding subject DBs 33*a*–33*n* in the case that a bingo board having a 5×5 blocks is used (S10).

Then, the twenty-five data materials are selected from the data pool at random, and thus data sets of i in which i denotes the number of participants are made different from one another (S11–S13).

Then, the twenty-five bingo data materials selected from the system server 1 are aligned in order at random and a playing card data to be provided to the participant terminal 2*a*–2*n* is determined (S14). Then, a data set is transmitted to each user, to fill the bingo board 6, and then playing card data is sequentially provided to play a bingo game (S15).

Here, in the case that a bingo data pattern provided to the participant and filled in the bingo board 6*a* is not desirable, a bingo data position filled in the bingo board 6*a* can be re-aligned according to his or her judgment and intention before playing the game. As a result, it is possible to induce users to be interested in the game and to positively participate in the game.

Basic Recognition Ability Enhancement

In this case, the data structure of the playing card 7*a* is made of multimedia data 40 including the graphic (or moving image) data 43, the character data 41 and/or the audio data 42 as described above.

In the game progress, a master of a game presents a playing card 7*a*, displays characters by the character data 41 under the card 7*a*, and simultaneously generates an acoustic output corresponding to the characters while activating the audio data 42. If desired, the acoustic output can be output repeatedly twice or three times.

The participant concentrates on finding out the same figure as that of the playing card 7*a* from the bingo board 6*a*, and listens to the repeated acoustic output, to thereby form a sensibility. In the case that a game is repeatedly performed with the identical subject, an interval of time at which the acoustic signals are repeated, that is, a period is shortened or the number of repetition times is shortened, to thereby enhance a recognition ability of the participant.

Thus, if a recognition ability is formed at a considerable degree, the playing card 7*a* including the graphic data 43 is not presented but the bingo data of the bingo board 6*a* can be marked with only acoustic output or characters.

The participant can form a basic recognition ability with respect to a game subject and game data, through the above learning procedure.

Application for Language Learning

Since a game can be played with the identical graphic data while language 50 of the character data 41 and the audio data 42 is changed into English or Japanese, a foreign language learning or a pronunciation exercise can be performed. Further, the kind of the language 50 provided according to the configuration setting value of the participant or the master of game is selected and simultaneously a pronunciation speed of the acoustic signal generated by the audio data 42 is adjusted. As a result, a language education matching a user level of knowledge and his or her purpose can be parallel.

The participant pronounces in response to the acoustic signal generated according to the audio data 42, and the voice of the participant is received to the corresponding terminals 2*a*–2*n* using a microphone. Then, it is preferable that the voice of the participant is analyzed and his or her pronunciation can be corrected by a well-known application software.

Expression Ability (Conversation) Learning

If the audio data 42 is provided as a sentence beyond a simple word level, and an illustration corresponding to the sentence is provided to the playing card 7*a*, it is possible to learn an expression ability. In particular, when a certain subject, for example, such as at restaurant, school or swimming pool, is given and then situations which can occur there are presented as each sentence for the twenty-five playing cards 7*a*, it is possible to perform an effective dialog learning.

Memory Power Enhancement with Respect to Corresponding Items

Data of the playing card 7*a* and that of the bingo board 6*a* does not match, and respectively corresponding items are compared, to thereby test a memory power or common sense with respect to various learning contents. For example, items which can correspond to irregular verbs and events and chronicle annals with respect to each other on a one-to-one basis are established, to then proceed with playing a game. By doing so, a memory power can be tested or enhanced.

Application for Mental Calculation

In a bingo game according to the present invention, expressions or problems for a mental calculation is displayed on the playing card 7*a* and answers for the mental calculation are aligned in the bingo board 6*a*, to thereby test or enhance a mental calculation ability. In this case, if mental calculation expressions or handling numbers are set properly according to the intelligent quotient and learning step of a participant, a more effective mental calculation ability can be cultivated.

Figure 7:
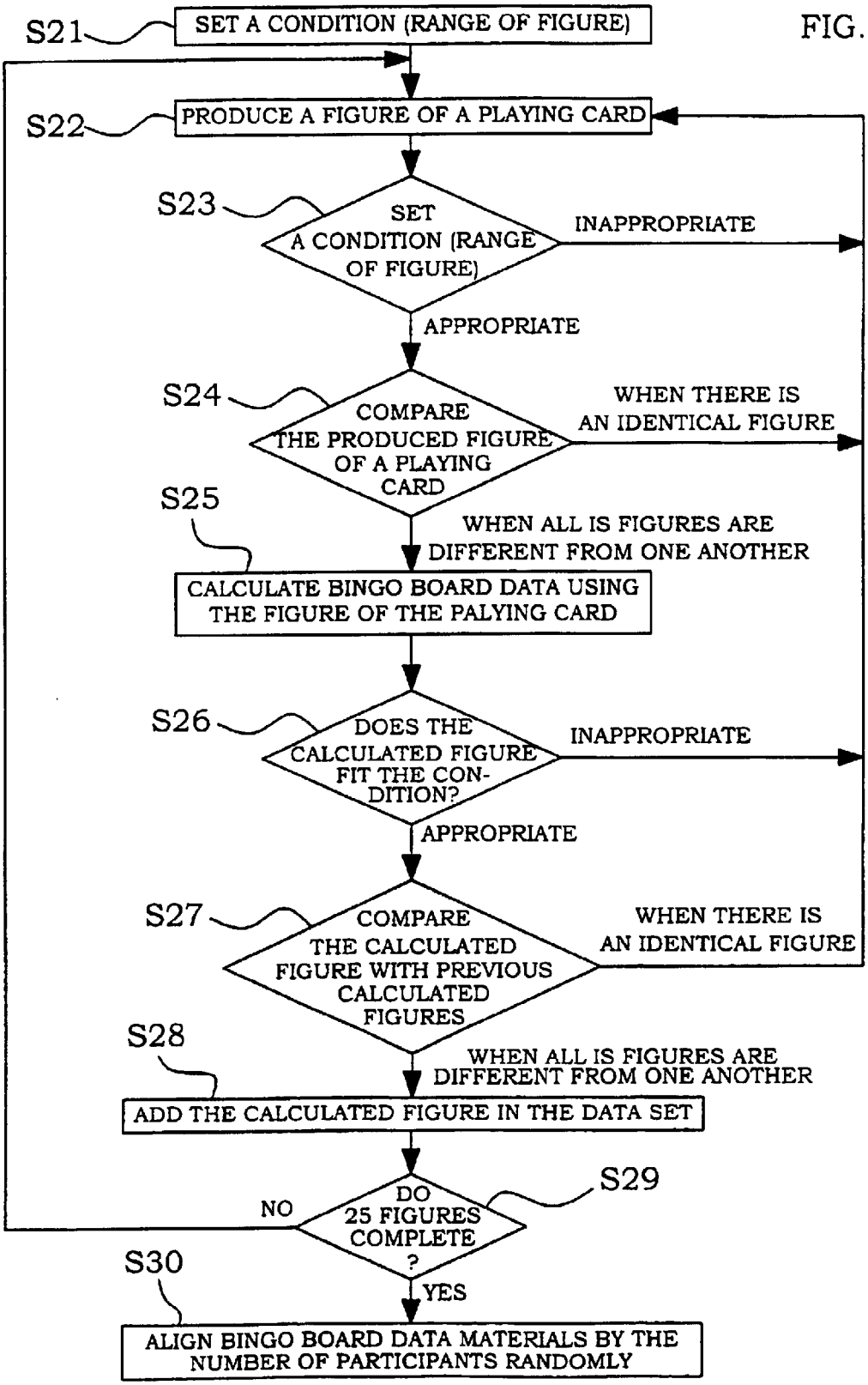
FIG. 7 is a flowchart view showing a process of creating a bingo board and a playing card for a bingo game for enhancing a mental calculation ability according to the present invention.

FIG. 7 is a flowchart view showing a process of creating a bingo board and a playing card for a bingo game for enhancing a mental calculation ability via the bingo game according to the present invention. First, a condition establishment is performed in step S21 that a handling number such as a single digit, a double digit or a triple digit are determined according to an intelligent quotient and learning step such as a first step, a second step, a third step, etc., of a participant, as shown in the following Table 1. Then, a figure such as 2, 3, 5, 1, etc., of the playing card 7*a* is created (S22).

TABLE 1

| Level | Playing card | Bingo board |
|---|---|---|
| 1st step | 2 + 3, 5 + 2, 2 + 1, . . . | 5, 7, 8, 3, . . . |
| 2nd step | 12 + 35, 55 + 31, | 47, 86, 47, . . . |
| 3rd step | 3 × 4, 5 × 2, 7 × 2, | 12, 10, 14, 24, . . . |
| . | . | . |
| . | . | . |
| . | . | . |
| n-th step | | |

Thereafter, it is judged whether the created figure in the playing card 7*a* matches the above condition. If matched, the created figure is compared with the previously created figure, to thereby judge whether the same figures exist (S23 and S24). If the same figures do not exist in the result of judgment, these figures are included in the data pool, and a data operation (for example, "+. −, ×, ÷") for the bingo board is performed with a figure combination such as two and five, five and two, five and three and two and one of the playing card 7*a* extracted from the data pool (S25). Then, it is judged whether a calculated figure (for example, 5, 7, 8 and 3) of the bingo board 6*a* matches the condition in the result of the operation (S26).

In the case that the calculated result value matches the condition in the result of judgment, and the calculated figures are different among the others in the result of comparing the calculated figure with the previously calculated figures, the figure combination is added in the data set (S27 and S28).

In the same manner, twenty-five figure combinations (for example, in the case that a 5×5 bingo board is used) are completed (S29), data for the bingo board 6*a* is re-aligned at random by as many as the number of participants to thereby create data sets in correspondence to the number of the participants (S30).

That is, in the mental calculation bingo game according to the present invention, data of a bingo board and a playing card is not made directly from the bingo data materials BD1-BDn, but made from a figure range of a learning ability or a demand ability. Thus, figures within the presented conditional range are randomly produced and aligned in the data pool. Here, the mental expression (for example, 2+3, 5+2, 5+3, 2+1, etc.) is put in the playing card 7*a* and the answer (for example, 5, 7, 8, 3, etc.) is put into the data pool of the bingo board 6*a*. The aligning method of the bingo board 6*a* and the playing card 7*a* is same as the basic model shown in FIG. 6.

Figure 8:
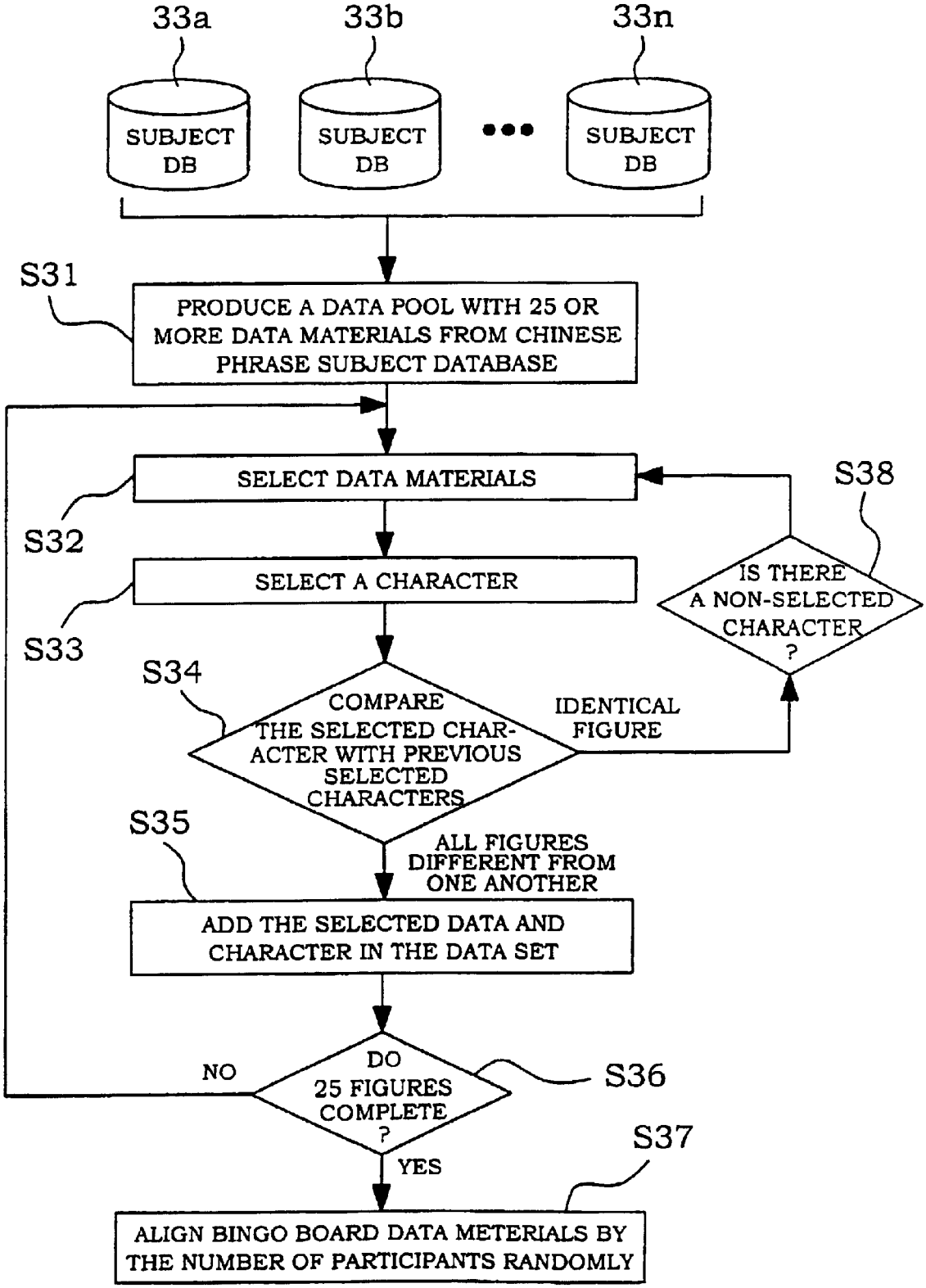
FIG. 8 is a flowchart view showing a process of creating a bingo board and a playing card for a bingo game for enhancing a Chinese character phrase learning ability according to the present invention.

Meanwhile, FIG. 8 is a flowchart view showing a process of creating a bingo board and a playing card for a bingo game for enhancing a Chinese character phrase learning ability according to the present invention, which will be described below in detail.

First, a data pool is created with twenty-five or more data materials from the Chinese character phrase subject DBs 33*a*–33*n* (S31). Then, a Chinese character phrase data material is selected from the data pool (S32), and a character is selected from the Chinese character phrase data materials (preferably, a four-letter phrase) (S33).

Thereafter, it is judged whether the same character exists in the result of comparing the selected character with the previously selected characters (S34). In the case that the same character exists in the result of judgment, it is judged whether there exists a character which is not selected yet in the data. If there is a non-selected character, the program advances to step S33 to select another character. If there is no non-selected character in the data, the program advances to step S32, to select new Chinese character phrase data (S38).

In the case that there is no same character in the result of comparing the selected character with the previously selected characters and in the result of judgment of step S34, the selected Chinese character phrase data and the selected character are put into the data set (S35).

In the same manner, the process of putting the twenty-five Chinese character phrase data materials and the selected characters into the data set is repeated, to thereby prepare twenty-five Chinese character phrase data sets (S36). Then, twenty-five selected characters are randomly re-aligned by as many as the number of participants, to thereby produce data for the bingo board 6*a* (S37).

In the Chinese character phrase learning bingo game, the bingo board data is transmitted to the participant terminal to fill the bingo board 6*a* with the same. Then, when a Chinese character phrase is presented as a playing card 7*a*, a character is deleted from the graphic data 43 and then presented.

Accordingly, the game proceeds in a manner that a participant corrects the deleted character and clicks a corresponding character in the bingo board 6*a*. As a result, when the game is repeatedly performed, a perception enhancement and a learning effect with respect to Chinese character phrases is naturally obtained.

Further, it is preferable that the graphic data is separated from the character data in the bingo games for the mental calculation and the Chinese character phrase learning. That is, when the figures in the mental calculation bingo game are arabic figures, for example, 1, 2, 3, etc., and the Chinese character phrases for the Chinese character phrase learning are made of Chinese characters, but the character data is made of each language notation, for example, il in Korean, one in English, ein in Germany, etc., in case of an arabic figure, and keum in Korean, geld in Germany, gold in English, etc., in case of Chinese character chin, a language learning effect is obtained according to language selection.

Depending upon which field is applied with the bingo game according to the present invention, the process of creating data of the bingo board and the playing card is varied somewhat. However, data corresponding to the answer of the problem is provided to the bingo board 6*a* and data corresponding to the problem is provided to the playing card 7*a*, even in any applications.

As described above, various bingo boards and playing cards can be created. A multipersonal Internet bingo game procedure will be described in detail with reference to FIG. 9A.

Figure 9A:
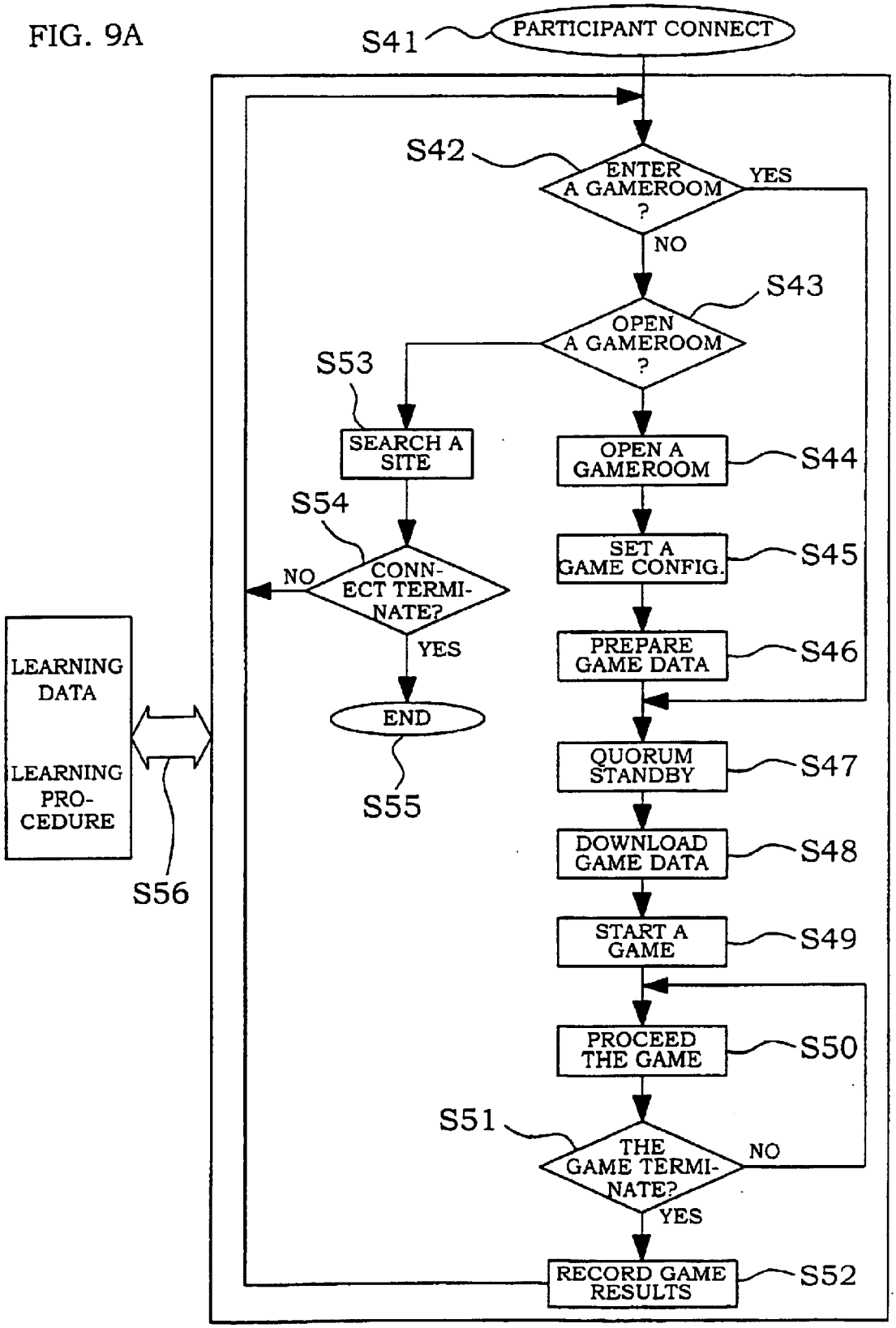
FIG. 9A is a flowchart view for explaining an Internet bingo game method having a perception and learning ability enhancement effect according to the present invention, in the place of a server.
Figure 13:
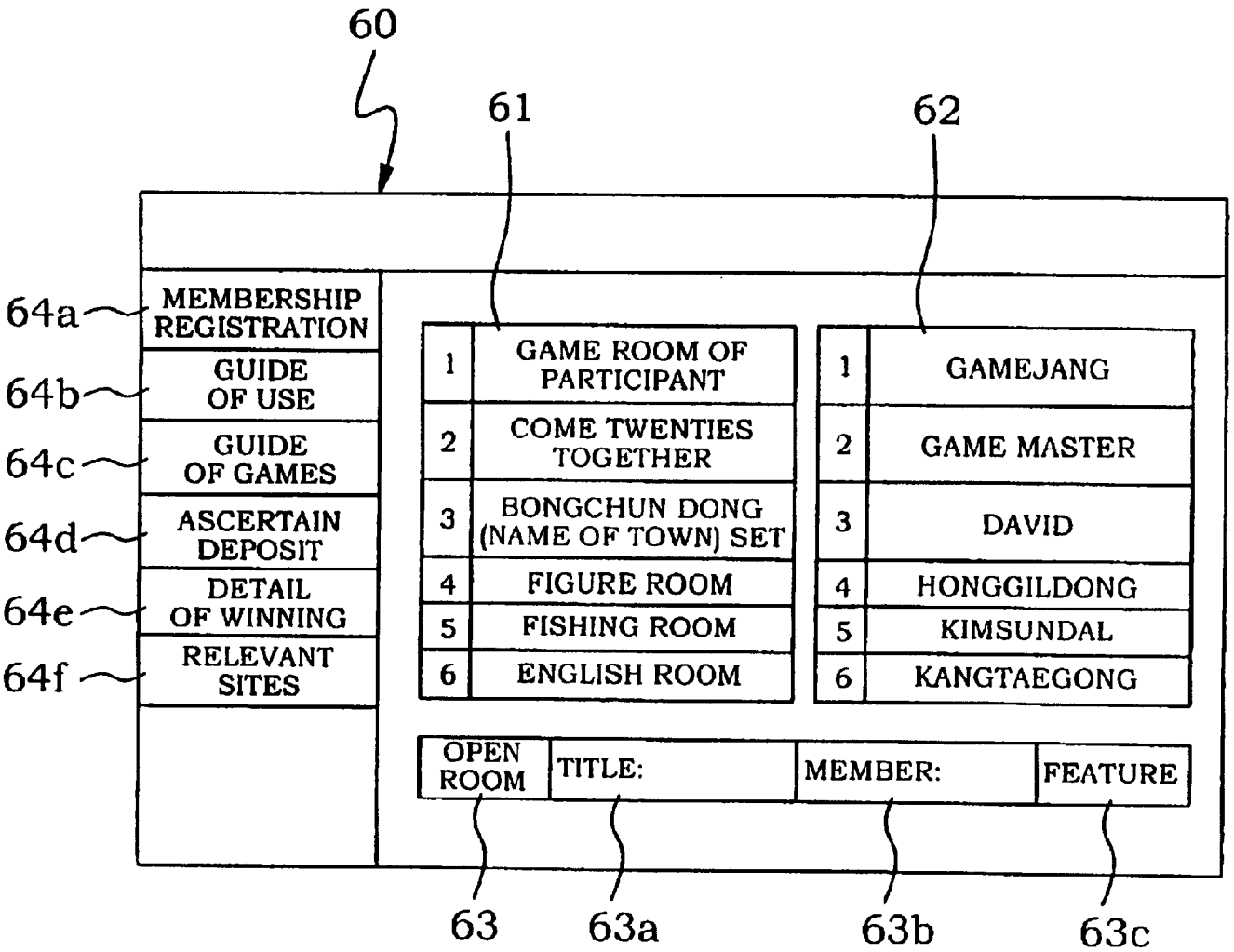
FIG. 13 shows an example of a connection screen in a personal computer (PC) game room according to the present invention.

First, referring to FIG. 9A, if a user or a game participant connects with the system server 1 which is connected to the Internet network 3 by using a web browser 21 in a participant terminal 2*a*, a game room connection screen 60 shown in FIG. 13 is provided (S41). Referring to FIG. 13, when a unit of a game played by a group at the same time is defined as a game room, a game room list 61 with respect to a number of already opened game rooms and a user ID list 62 are provided on the screen. A room opening menu 63 for guiding a user to open a new game room is arranged under the game room list 61 and the user ID list 62. The game room connection screen 60 is only an example, and it is possible to configure it to have another screen and function.

If the room opening menu 63 is clicked, a more detailed menu is provided, for writing or setting a room title 63*a* of a new opened game room, the number of the participants 63*b*, and a room characteristic 63*c* with respect to whether the room will be opened or not be opened.

Also, the game room connection screen 60 includes a member registration menu 64*a* for member registration, a user guide menu 64*b* for guiding a use of a home page such as a game, an e-mail service, a learning data guide, a shopping mall user guide, a game guide menu 64*c* for guiding principles, winning point management rules, and premium details of various bingo games, a deposit money ascertaining menu 64*d* for ascertaining a deposit money of each user, an awarding detail menu 64*e* for guiding an awarding detail of an even game, and a relevant site menu 64*f* which can link with various cooperative shopping malls.

A user who wishes to play a game connects to the server 1, and then selects one of the previously opened game rooms from the game room list 61 on the game room connection screen 60, to thereby participate in the selected game room (S42) Otherwise, a user who wishes to play a game clicks the room opening menu 63 to open his or her own game room (S44).

Figure 10:
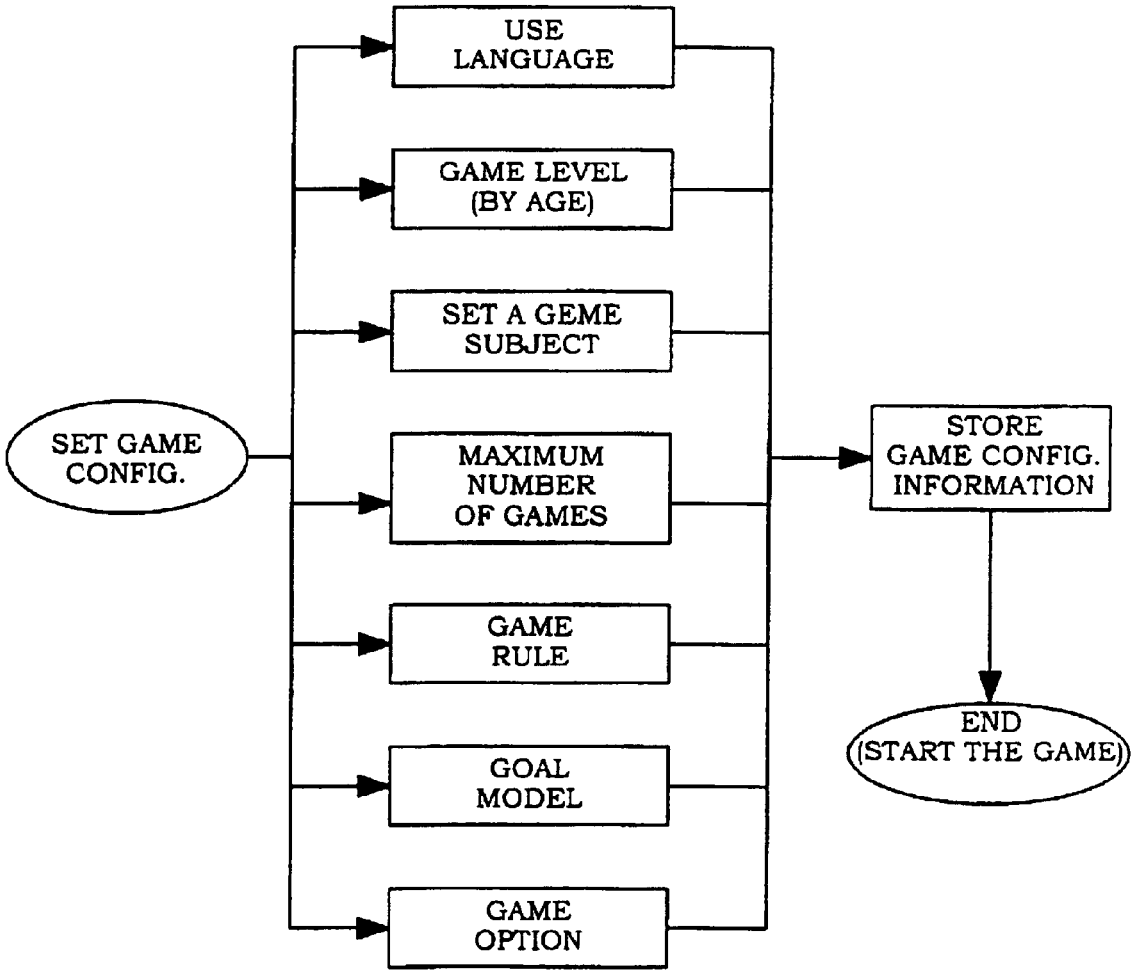
FIG. 10 is a flowchart view showing a configuration setting process of a game.

In this case, the user who opened the game room determines basic items of his or her desired game via a game configuration setting function shown in FIG. 10, and awaits until other users will participate in his or her game room. Here, the determined game configuration can be altered via an opinion exchange among the users. Also, when a quorum is not met, or if desired, a virtual user is generated without awaiting actual users, to thereby play a game as if actual users participate.

Game configuration elements to be determined in order to play a bingo game are as follows.

Use language: A basically use language should be selected, but all of users in a game room need not use the same language. In the case that a purpose of a game is a language learning, a language having a learning purpose is one thing and an analytic language is another thing, and both languages should be displayed.

Game level: Since a use terminology ranges by age of learners, it is preferable that a game level is divided by age.

Subject of game: A concrete object of a game is determined. A plurality of game subjects can be selected in order to make data abundant.

Maximum game participants: The number of users should be restricted in view of a program development technique. When a winning point is managed in a user position, the number of game participants is based on calculation of the winning point.

Game method: A game method is divided into a method of accumulating and managing a winning point in which a small number of participants come together and play a game (a single-winner decision method or a game type) (refer to FIG. 11) and a plural-winner decision method (event type) in which a large scale number of participants come together and several upper-ranked participants become winners (refer to FIG. 12). In the case that the number of participants is short of a quorum in a game type, virtual participants can be created.

Goal model: As shown in FIGS. 2A–2D, there are a single bingo that a marked block pattern forms a single line irrespective of width, length and diagonal lines, a double bingo that the number of straight lines is two, and a triple bingo that the number of straight lines is three. Besides, there is a pattern bingo that a particular shape is a goal.

Game option: Data of the playing card is formed of character, audio and graphic (moving image) data, but these three elements need not be presented but presented according to a performance degree of learning. Thus, whether or not these data materials are presented should be determined as an option. In case of audio data, it needs to output a few times in order to enhance a learning effect, in which case the number of repetition times, an interval of time and a pronunciation speed should be determined.

Graphic style: A different style picture can be selected as even same data according to users' tastes, in order to play a game.

After a game configuration with respect to the above factors has been set, configuration information is stored (S45). Then, only data necessary for a game is selected from the bingo DB 33. These create the bingo board 6*a* and the playing card 7*a* according to a procedure shown in FIGS. 6 through 8 (S46).

Then, the game room opener awaits until other participants participate, or generates virtual participants until a total of participants reach the maximum game participants, to then proceed with playing a game (S47). In this case, if a game starts when the total participants do not reach the maximum game participants, virtual participants are generated automatically in order to play a game. Otherwise, since a winning point has no large meaning in the case of an educational game, virtual participants are not generated and the game proceeds.

In order to start a game, data necessary for the game should be transmitted from the system server 1 to each of the participant terminals 2*a*–2*n*. The transmitted data is displayed on a participant terminal screen, that is, a game screen 65 as shown in FIG. 14, by a web program, to thereby configure each bingo board 6*a* (S48).

The game screen 65 shown in FIG. 14 is an example of a screen in the case that five persons play a bingo game together. In addition to his or her own bingo board 6*a*, other bingo boards 6*b*–6*d* are provided, which makes one participant check proceeding situations of other participants. There exists a playing card 7*a* on one side and a character data display 7*b* under the playing card 6*a*.

Also, on the game screen 65 are there a bingo menu 66 used for announcing a "bingo", and a number of additional service menu 67 for enabling the participants to use additional functions such as a use record of performance, a password alteration, an e-mail transfer, a game record of performance check, etc.

Further, on the game screen 65 is provided a chatting space 68 so that a game configuration setting, a game start, a proceeding of an additional game, messages which a master of game (game master or supervisor) transfers to members, etc., can be exchanged after discussion during proceeding a game. For this purpose, a chatting service supported by a chatting program is provided.

A game starts by a game room opener (S49). During proceeding a game, data of the playing card 7*a* is transmitted from the server 1, and the result displayed on the bingo board 6*a* is transmitted to the server 1 and terminals 2*a*–2*n* of the other participants (S50).

As the game proceeds, each participant clicks a corresponding block in the bingo board 6*a* matching the playing card 7*a* which is sequentially provided to the participant. In this case, a pattern corresponding to a predetermined goal model is formed on one participant bingo board 6*a*.

Here, if the participant clicks a bingo menu 66, a win or lose of the game is determined. Immediately, the server 1 stops transmission of the playing card 7*a* and closes the game (S51). Then, an administration program for recording the game results of participants is operated to thereby record the game result in the participant DB 31 (S52).

Thereafter, it is asked whether or not the game continues to play the game once more. Otherwise, in the case that an additional learning desire concerning a game subject occurs, subject-related learning data materials SD1-SDn are provided to thereby proceed with a learning procedure (S56). The subject learning procedure can be taken before a game participant enters the game room, or can proceed irrespective of participation of the game.

In the case that a winning point is given according to his or her game record of performance after completion of the game, the participant can search the link sites 64*f*, and visit a cooperative shopping mall which is run by a cooperative shopping mall server 4, to thereby purchase desired products and services on an electronic commerce basis and terminate the connection to the server 4 from the participant terminal (S53 and S54).

Figure 9B:
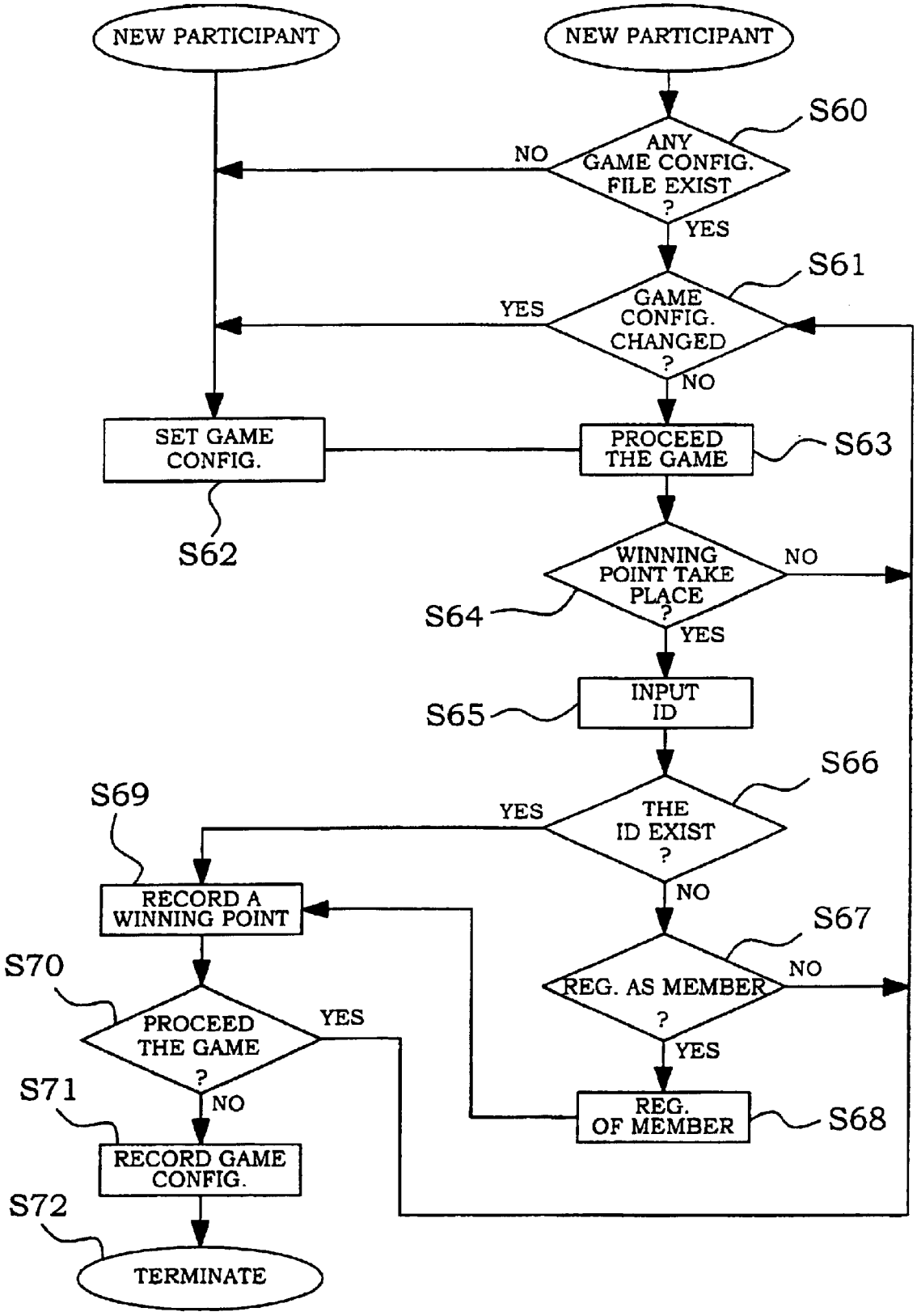
FIG. 9B is a flowchart view for explaining an Internet bingo game method having a perception and learning ability enhancement effect according to the present invention, in the place of a participant.

Hereinbelow, an Internet bingo game method having a perception and learning ability enhancement effect according to the present invention, will be described with reference to FIG. 9B, in the place of a participant.

In general, since various items such as a game configuration should be input before starting a game, users feel so inconvenient. Thus, such an inconvenience need to be solved. For this purpose, the game configuration is stored in a configuration file and retrieved to use it. That is, as shown in FIG. 9B, assuming that a participant re-connects with a game which has been terminated before, in order to play the game, a previously played game configuration is stored and the stored game configuration can be re-used.

That is, in the case that the old participant connects with the server 1 and then his or her opened and stored game configuration file exists (S60), it is judged whether the game configuration will be changed firstly (S61). If the game configuration will be changed or the participant is a new participant, a game room is opened and a procedure of setting a game configuration as shown in FIG. 10 is undergone (S62).

Sequentially, the game proceeds (S63). When a winning point is generated (S64), the participant enters his or her own ID (S65). If an ID does not exist, a member registration procedure is undergone so as to be registered as a member (S66–S68). If an ID exists, a winning point is recorded (S69).

Since a process of interning the ID during playing a game is evaded considerably in order to use an Internet game generally in view of administration of the winning point, an ID can be entered only in the necessary cases after completion of the game. In the case that a participant desires, an ID can be entered before starting a game or performing a log-in process to a server.

Then, if the participant wishes to continue to play a game, the program proceeds to step S61, to thereby proceed with playing a new game. Otherwise, a game configuration is recorded and disconnects from the server, to then terminate the game (S70–S72).

Figure 11:
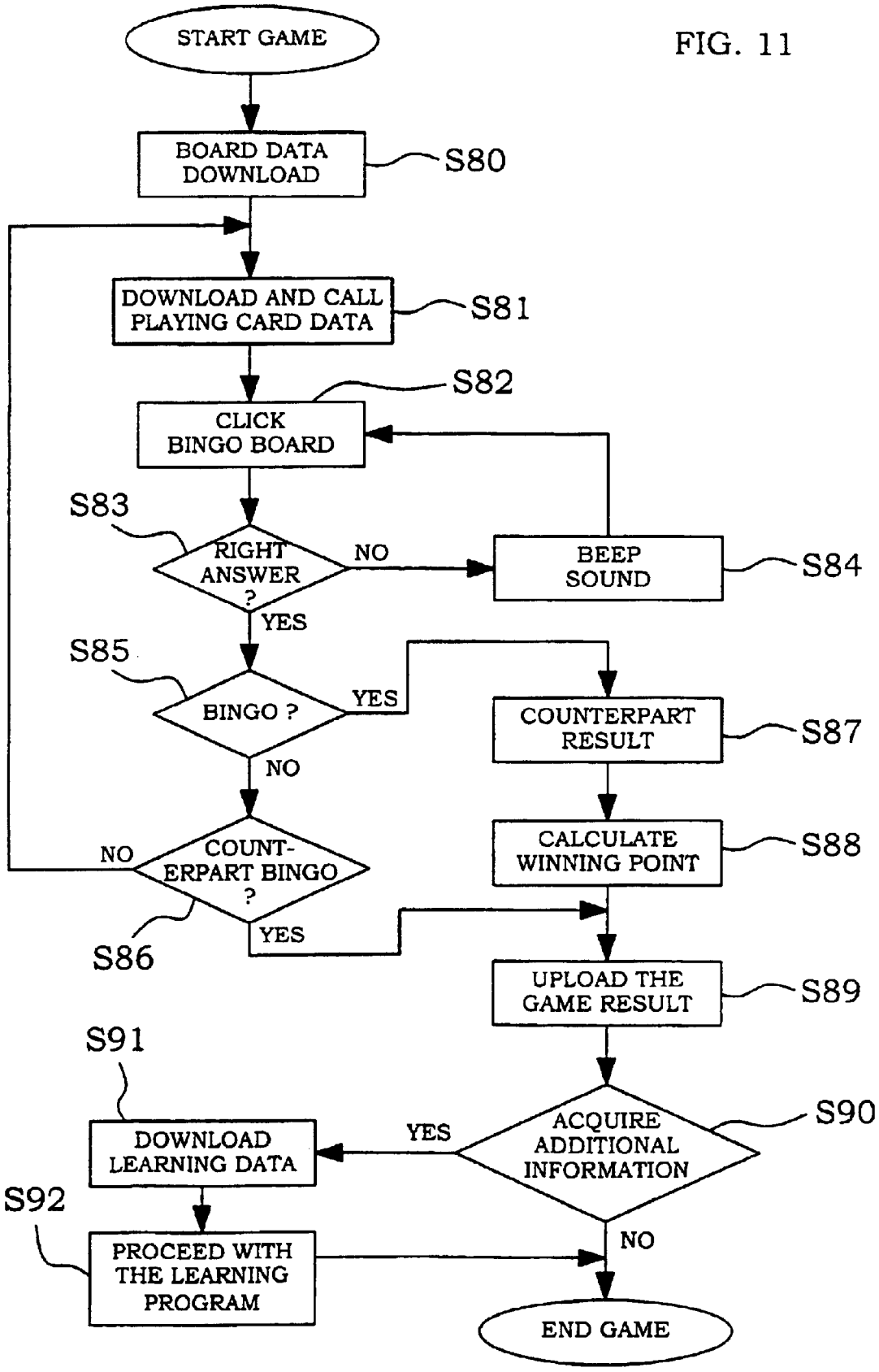
FIG. 11 is a flowchart view showing a game proceeding process of a single-winner decision method (game type) according to the present invention.

FIG. 11 is a flowchart view showing a game proceeding process of a single-winner decision method (of a game type) according to the present invention. First, if a subject of a game is determined at a configuration setting by a decision of a game supervision company, a data pool is formed with bingo data materials contained in the corresponding subject. Form the data pool, a random number is used to create a respectively different arrangement to thereby produce respective user data sets.

In order to play a bingo game, for example, twenty-five bingo data materials are downloaded from the server 1 to the participant terminals 2*a*–2*n*, and then the downloaded twenty-five bingo data materials are displayed on the bingo board 6*a* of the respective participant terminals 2*a*–2*n* (S80).

Thereafter, as the game starts, the playing card 7*a* is downloaded. While calling the playing card 7*a*, the respective participants mark a right answer on their bingo boards 6*a* in correspondence to the called playing card 7*a* (S81 and S82), and judge whether a right answer has been clicked (S83). If a right answer has not been clicked, a beep sound is generated, to guide the participant to click a right block on the bingo board 6*a* (S84).

The above right answer marking process is repeated until any one participant complete a predetermined bingo model. If an initial bingo creator, that is, a winner takes place (S85), a winning point is calculated according to the counterpart's result in the case that he or she is the winner who forms a bingo (S87 and S88). In the case that a bingo takes place at the counterpart's side (S86), the game result is transmitted to the server 1, and the game results and the winning points of all the participants are recorded on the participant DB 31 by a management program (S89).

Meanwhile, if there is a need to acquire additional information with respect to a game subject or specific data (S90), the learning data SD1-SDn are downloaded to perform a learning program (S91 and S92).

Figure 12:
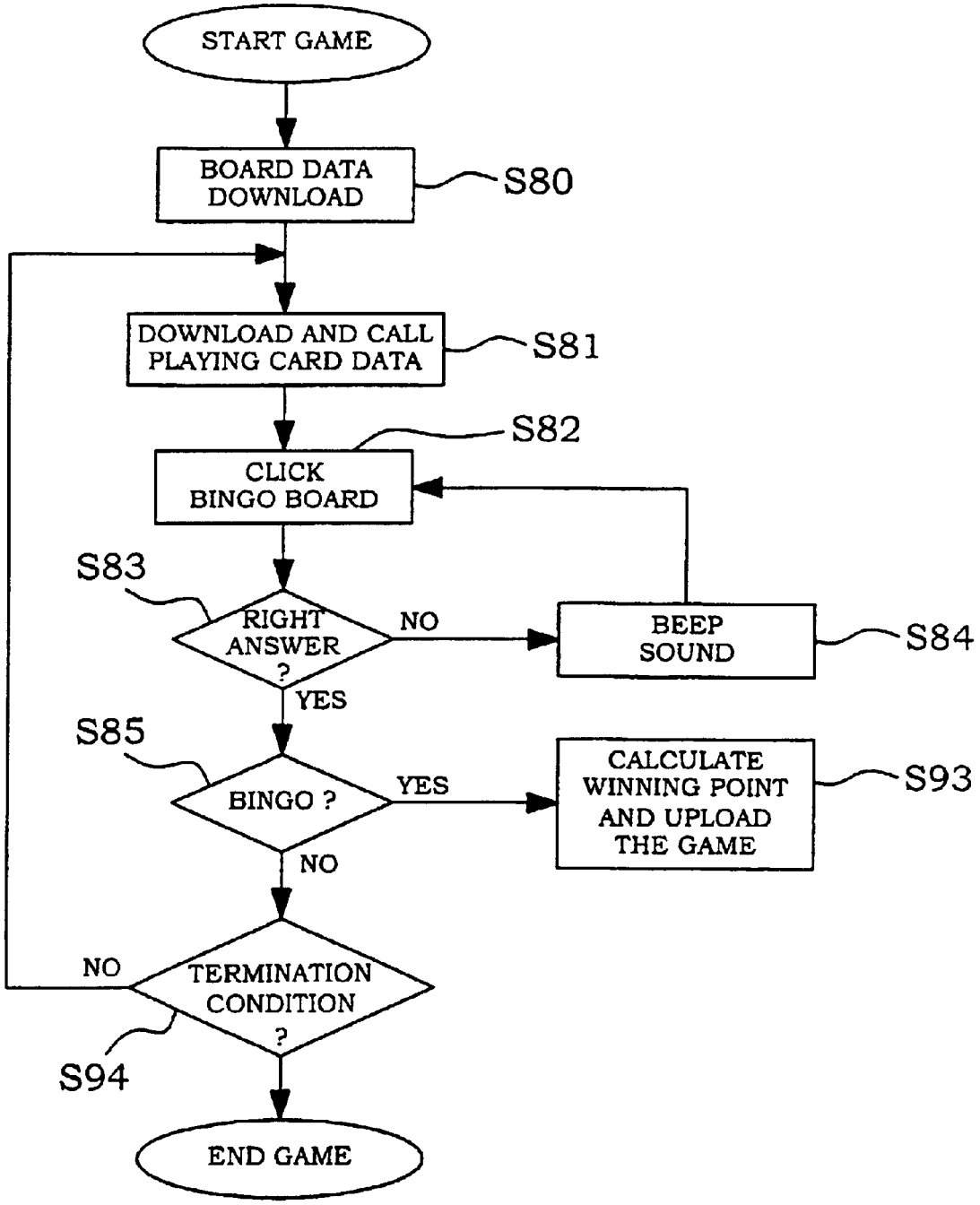
FIG. 12 is a flowchart view showing a game proceeding process of a plural-winners decision method (event type) according to the present invention.

FIG. 12 is a flowchart view showing a game proceeding process of a plural-winners decision method (of an event type) according to the present invention. The event type bingo game is a game proceeding for the participants who participate in the bingo game on a large scale, in which several winners including a first ranker are selected.

The even type bingo game has the same procedures as the game type bingo game in steps S80 through S85.

That is, if a game subject in the event type bingo game is determined in a configuration setting in the same manner as that of the game type, a data pool is created with the bingo data materials of the corresponding subject, from which a respectively different alignment is made using a random number, to thereby create respective participant data sets.

In order to play a bingo game, a predetermined number of bingo data materials are downloaded from the server 1 to the participant terminals 2*a*–2*n*, and then the downloaded bingo data materials are displayed on the bingo board 6*a* of the respective participant terminals 2*a*–2*n* (S80).

Thereafter, as the game starts, the playing card 7*a* is downloaded. While calling the playing card 7*a*, the respective participants mark a right answer on their bingo boards 6*a* in correspondence to the called playing card 7*a* (S81 and S82), and judge whether a right answer has been clicked (S83). If a right answer has not been clicked, a beep sound is generated, to guide the participant to click a right block on the bingo board 6*a* (S84).

The above right answer marking process is repeated until any one participant complete a predetermined bingo model.

Even if a bingo takes place, the bingo game is not terminated but a winning point is accumulated and the bingo game continues, to upload the game result (S93). In this manner, the bingo game continues until all of predetermined rank bingos are created and a termination condition is met, and then the bingo game is terminated in the case that all of the predetermined rank bingo have been created (S94).

The termination condition can be set with a predetermined time, or the number of call cards in addition to a predetermined number of rankers.

In a general game, a top ranker should await for a considerable time until the game is terminated. Thus, even the ranked participants can participate in the successive game in order to make the participant immersed in the game, in which a winning point is added with respect to any additionally created bingo after completion of a bingo.

FIG. 15 shows an example of a screen presented in the case that two participants play a game in a single terminal according to the present invention, in which six participants can enjoy the game together. Here, two main bingo boards 6*a* and 6*f*, two bingo menus 66 and 66*a* and four network participant small bingo boards 6*a*–6*e* are provided. Other remaining composition is the same as that of FIG. 14.

In this case, a plurality of main bingo boards 6*a* and 6*f* are provided on the screen, if desired. Accordingly, families or friends come together in front of a single PC to enjoy an Internet bingo game.

Here, a combination of a well-known mouse and directional keys, a combination of a number of mouse and/or alphanumeric keys of a keyboard, are defined as a means for inputs of a number of users. Accordingly, a plurality of users use a single PC to thereby simultaneously enjoy a game.

Meanwhile, in the present invention, a guidance teacher participates in a bingo game as a game master, and selects a subject of the game appropriate for an educational program in consideration of a level/age of students. Then, bingo board data materials are provided as answers with respect to problems and playing card data materials are provided as problems in the form of multimedia data. Supplemental materials and hints with respect to the problems are provided through a chatting space. As a result, a game and an education is linked with each other, to thereby put an Internet education into practice.

The above description of the embodiments has been made with respect to examples of enhancing a recognition ability and obtaining an educational learning effect. However, in the case of the Internet bingo game according to the present invention, a publicity of a company or an advertisement of a product is established as a game subject, in addition to the educational materials, to thereby provide advertisement information via the game and learning process.

Further, the home page according to the present invention further includes a print option menu for enabling a user to print a bingo board 6*a* and a playing card 7*a*, in order to enjoy playing a bingo game in the open air. In the case that a user selects a print option, bingo boards 6*a* and playing cards 7*a* are created by as many as he or she wants according to his or her set game configuration. Then, if a print command is given in order to print the bingo boards and the playing cards, the data of the created bingo boards 6*a* and playing cards 7*a* are converted into a particular form of print files, and then the conversion result transmitted to the user. Accordingly, it is possible for the user to print the transmitted print files with a printer connected to the user terminal. In this case, it is possible to add an advertisement to part of the printed bingo board 6*a* and/or playing card 7*a*, in which the advertisement contents are included in the data of the downloaded bingo board and playing card, in cooperation with an advertisement sponsor.

In particular, in the case that advertisement information is provided as a subject, a preset cyber cash, discount coupon, cash or premium is provided for a top ranker, using the sponsor expenses of an advertising company, to thereby induce participants to positively participate in the game.

Also, in the case that a game subject is set as various arts, entertainments, amusements, hobbies, common senses, professional sports in the present invention, various specialists in each field can be absorbed into a bingo game.

For example, in the case that a game subject is set as everything with respect to popular players in the professional sports field, positive interests of fan club members supporting corresponding popular players are drawn to the bingo game.

Also, in the case that a fishing is set as a subject of the hobby, it can draw an interest of a number of fishers who like fishing.

Further, in the case that the present invention is applied to the art field, in particular, painting, and a subject is determined by era or author and an art work image is provided as graphic data, the present invention can be applied to appreciation of the art work.

Meanwhile, in the above embodiments, the bingo game uses a 5×5 bingo board. However, if desired, it is possible to alter the number of blocks included in the bingo board, such as 3×3, 4×4, 6×6, etc.

For example, in the case of kids, a 3×3 or 4×4 dimensioned bingo board can be applied. In the case of adults, a bingo board having a 5×5 dimension or greater can be used.

INDUSTRAIL APPLICABILITY

As described above, during playing an Internet bingo game in the present invention, problems enhancing a perception and learning ability are provided to the playing card data provided from the server to the participant terminal, as multimedia data, and the bingo data materials for the bingo board are provided as answers with respect to the problems, to thereby enhance a perception and learning ability with respect to each subject via the game.

Also, the Internet bingo game method and system is capable of inducing a game participant to undergo learning an explanation with respect to a game subject to be selected before the game participant participates in a bingo game and further enhancing a perception and studying ability with respect to each subject.

Further, the Internet bingo game method and system can enhance a learning ability of various languages including Korean and English, during playing a bingo game using the Internet, in which playing card data is configured by multimedia data including graphic data (or moving images), character data and audio data, in order to graphically present playing cards, while displaying characters under the cards and simultaneously outputting acoustic data repeatedly, to thereby induce the participant to understand the characters and acoustic data to then click a corresponding bingo block in a bingo board.

Further, the present invention provides an effect of providing advertisement information via a learning before playing a game and via the game, in the case that a publicity of a company or an advertisement of a product is established as a game subject, in addition to the educational materials.

Also, the present invention provides an effect of inducing specialists of various fields into a game, in the case that a variety of entertainments, amusements, hobbies and common senses are established as a game subject, in addition to the educational materials.

The present invention is not limited in the above-described embodiments. It is apparent to a person skilled in the art that there are many variations and modifications, within the scope which does not depart off from the spirit of the present invention.

What is claimed is:

1. An Internet bingo game method having an effect of enhancing a perception ability and a learning ability, the Internet bingo game method comprising the steps of:

making a bingo data set with $N^2$ selected learning subject bingo data materials in order to fill an N×N bingo board in which N is an integer equal to or more than three, from a number of learning subject databases when at least one user connects from each participant terminal to a system server and applies for participating in a game;

aligning the $N^2$ bingo data materials in the data set at random to thereby produce respectively different data sets by as many as the number of game participants;

transmitting the respectively different bingo data set from the system server to each participant terminal so as to fill a bingo board of each participant terminal;

converting the N2 bingo data materials into multimedia data and providing the multimedia data randomly and sequentially to each participant terminal as playing card data; and selecting a corresponding block of the bingo board corresponding to a corresponding playing card whenever the participant terminal receives the playing card, to thereby make a participant who forms a predetermined bingo goal pattern in the earliest announce a bingo, wherein problems enhancing a perception and learning ability are provided to the playing card data provided from the server to the participant terminal, as multimedia data, and the bingo data materials for the bingo board are provided as answers with respect to the problems.

2. The Internet bingo game method of claim 1, further comprising the step of allowing a game participant to learn an explanation with respect to a game subject to be selected before or after participating a bingo game.

3. The Internet bingo game method of claim 1, further comprising the steps of setting a game configuration in order to establish at least one among game termination conditions set with any one among a game subject, a game level, a maximum number of gamers, a gaming rule, a goal pattern, use language of multimedia data, graphic style, the number of times of bingo, a game progress time and the number of playing card and a game option of the bingo game, in which a bingo board and playing card data is selected according to a pre-stored game configuration in the case that a following bingo game.

4. The Internet bingo game method of claim 1, wherein said bingo data set making step comprises the sub-steps of:

selecting one or more subjects among a number of subjects at the configuration setting time of the participant;

forming a data pool having a number of bingo data materials included in the respective subject databases according to the selected subject and playing a role of answers with respect to problems; and selecting $N^2$ bingo data materials to fill the bingo board from the dat pool to thereby make a data set.

5. The Internet bingo game method of claim 1, further comprising the steps of:

continuing to play the same bingo game in succession to the primary bingo annunciation; and accumulating and calculating a winning point of the participant in the case that the same participant announces the secondary bingo, in the result of playing a game in succession to the primary bingo annunciation.

6. The Internet bingo game method of claim 1, wherein respectively different bingo board data materials corresponding to the number of applicants are transmitted to one of said terminals, when one or more users apply for participating a bingo game using a single terminal, respectively.

7. The Internet bingo game method of claim 1, further comprising the steps of converting the bingo board and playing card selected by the user into a into a separate form of print files and transmitting the same to the user.

8. The Internet bingo game method of claim 1, wherein said participant re-aligns the bingo board filled with the received data set.

9. The Internet bingo game method of claim 1, wherein virtual participants are automatically created by as many as the remaining shortage persons, in the case that the participant starts to play a game before the number of participants reaches the maximum gamers.

10. The Internet bingo game method of claim 1, further comprising the step of providing supplemental materials helpful for solving problems after having provided the playing card, to the respective participants.

11. An Internet bingo game method of having an effect of enhancing a perception ability and a learning ability, the Internet bingo game method comprising the steps of:

making a bingo data set with $N^2$ selected bingo data materials in order to fill an N×N bingo board in which N is an integer equal to or more than three, from a number of subject databases when at least one user applies for participating in a game;

aligning the $N^2$ bingo data materials in the data set at random to thereby produce respectively different data sets by as many as the number of game participants;

transmitting the respectively different bingo data set from a system server to each participant terminal so as to fill a bingo board of each participant terminal;

converting the $N^2$ bingo data materials into multimedia data and providing the multimedia data randomly and sequentially to each participant terminal as playing card data;

selecting a corresponding block of the bingo board corresponding to a corresponding playing card whenever the participant terminal receives the playing card, to thereby make a participant who forms a predetermined bingo goal pattern in the earliest announce a bingo; and, recording and analyzing the pronounced voice of the participant in response to the voice embodied by the voice data among the multimedia data of the playing card.

12. An Internet bingo game method having an effect of enhancing a perception ability and a learning ability, the Internet bingo game method comprising the steps of:

making a bingo data set with $N^2$ selected bingo data materials in order to fill an N×N bingo board in which N is an integer equal to or more than three, from a number of subject databases when at least one user applies for participating in a game;

aligning the $N^2$ bingo data materials in the data set at random to thereby produce respectively different data sets by as many as the number of game participants;

transmitting the respectively different bingo data set from a system server to each participant terminal so as to fill a bingo board of each participant terminal;

converting the $N^2$ bingo data materials into multimedia data and providing the multimedia data randomly and sequentially to each participant terminal as playing card data, said multimedia data including voice data;

selecting a corresponding block of the bingo board corresponding to a corresponding playing card whenever the participant terminal receives the playing card, to thereby make a participant who forms a predetermined bingo goal pattern in the earliest announce a bingo; and setting a repetition period, the number of times of repetition and pronunciation speed of voice embodied by the voice data.

13. An Internet bingo game system comprising:

a number of Internet accessible participant terminals each including a web browser; and a system server including a bingo database configured to have a number of learning subject databases each including a number of learning subject bingo data materials, a learning database including a number of learning data materials for explaining the subject bingo data materials in detail, and a web server making a bingo data set with $N^2$ selected learning subject bingo data materials in order to fill an N×N bingo board in which N is an integer equal to or more than three, from a number of subject databases when at least one user applies for participating in a game, aligning the $N^2$ bingo data materials in the data set at random to thereby produce respectively different data sets by as many as the number of game participants, transmitting the respectively different bingo data set to each participant terminal so as to fill a bingo board of each participant terminal, converting the $N^2$ bingo data materials into multimedia data and providing the multimedia data randomly and sequentially to each participant as playing card data, selecting a corresponding block of the bingo board corresponding to a corresponding playing card whenever the participant receives the playing card, to thereby make a participant who forms a predetermined bingo goal pattern in the earliest announce a bingo, the web server having a learning select menu for selecting learning data materials relating to the game subject, wherein problems enhancing a perception and learning ability are correspondingly provided to the playing card data and the bingo data materials in the bingo board are provided as answers with respect to the problems.

14. The Internet bingo game method of claim 1, wherein said system server comprises: a bingo board display displaying his or her own bingo board on each participant terminal when a participant applies for taking part in a bingo game of the system server; a number of small-sized bingo board displays for identifying other participants' processing situations; a playing card display displaying graphic data of the playing card; a character data display displaying the character data of the playing card; and a game screen including a chatting space for allowing for communicating an item to be transmitted between the participants.

* * * * *